US005343227A

United States Patent [19]

Hirosawa et al.

[11] Patent Number: 5,343,227

[45] Date of Patent: Aug. 30, 1994

[54] INK JET RECORDING APPARATUS AND INK JET RECORDING HEAD WITH MEANS REDUCING THE AMOUNT OF WARP

[75] Inventors: Toshiaki Hirosawa, Hiratsuka; Torachika Osada; Jiro Moriyama, both of Yokohama; Hidemi Kubota, Komae; Yutaka Koizumi, Yokohama; Mineo Kaneko; Yasushi Murayama, both of Tokyo; Yasushi Miura, Kawasaki; Haruhiko Moriguchi, Yokohama, all of Japan

[73] Assignee: Canon Kabushiki Kaisha, Tokyo, Japan

[21] Appl. No.: 649,724

[22] Filed: Feb. 1, 1991

[30] Foreign Application Priority Data

Feb. 2, 1990 [JP] Japan ..... 2-22181
Apr. 6, 1990 [JP] Japan ..... 2-90106

[51] Int. Cl.[5] ..... B41J 2/155; B41J 29/377

[52] U.S. Cl. ..... 349/42; 346/139 R; 346/145; 400/719; 347/18; 347/49

[58] Field of Search ..... 346/140 R, 1.1, 75, 346/139 R, 145, 139 C; 400/719, 53, 120 HE; 101/109

[56] References Cited

U.S. PATENT DOCUMENTS

| | | | |
|---|---|---|---|
| 3,929,327 | 12/1975 | Olson | 271/250 |
| 3,998,315 | 12/1976 | Phillips | 400/124 |
| 4,277,790 | 7/1981 | Heibein et al. | 346/75 |
| 4,313,124 | 1/1982 | Hara | 346/140 |
| 4,345,262 | 8/1982 | Shirato et al. | 346/140 |
| 4,361,087 | 11/1982 | Sato | 101/109 |
| 4,454,518 | 6/1984 | Bangs | 346/140 R |
| 4,459,600 | 7/1984 | Sato et al. | 346/140 |
| 4,463,359 | 7/1984 | Ayata et al. | 346/1.1 |
| 4,496,257 | 1/1985 | Habelt et al. | 400/578 |
| 4,521,805 | 6/1985 | Ayata et al. | 358/75 |
| 4,558,333 | 12/1985 | Sugitani et al. | 346/140 |
| 4,602,881 | 7/1986 | Prevignano et al. | 400/124 |
| 4,675,696 | 6/1987 | Suzuki | 346/46 |
| 4,723,129 | 2/1988 | Endo et al. | 346/1.1 |
| 4,728,967 | 3/1988 | Tomita et al. | 346/136 |
| 4,740,796 | 4/1988 | Endo et al. | 346/1.1 |
| 4,750,422 | 6/1988 | Gysin | 101/426 |
| 4,819,011 | 4/1989 | Yokota | 346/76 PH |
| 4,938,129 | 7/1990 | Miciukiewicz et al. | 101/76 |
| 4,994,825 | 2/1991 | Saito et al. | 346/140 R |
| 5,055,861 | 10/1991 | Murayama et al. | 346/140 R |

FOREIGN PATENT DOCUMENTS

| | | | |
|---|---|---|---|
| 0126479 | 11/1984 | European Pat. Off. . | |
| 0339926 | 11/1989 | European Pat. Off. . | |
| 0376309 | 7/1990 | European Pat. Off. . | |
| 0390202 | 10/1990 | European Pat. Off. . | |
| 0050244 | 4/1977 | Japan | 400/120 HE |
| 54-56847 | 5/1979 | Japan . | |
| 0100081 | 6/1982 | Japan | 346/140 PD |
| 59-123670 | 7/1984 | Japan . | |
| 59-138461 | 8/1984 | Japan . | |
| 60-71260 | 4/1985 | Japan . | |
| 62-56158 | 3/1987 | Japan . | |
| 1-259957 | 10/1989 | Japan . | |

OTHER PUBLICATIONS

Meier, J. H., "Mechanical X-Y Aiming of Ink Jet Printer Nozzles", IBM Technical Disclosure Bulletin vol. 15 No. 5 Oct. 1972, p. 1683.

*IBM Technical Disclosure Bulletin*, "Heat Transfer System for Serial Printers", vol. 28, No. 3, Aug. 1985.

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A recording medium in the sheet form is supplied into a designated direction guided by a sheet supply roller. An ink jet recording head in which a plurality of ink jet discharging orifices are arranged is placed in parallel with a surface of the recording sheet and in the direction perpendicular to the designated direction of supplying the recorded sheet. An adjustment screw is placed for correcting a warped shape of the ink jet recording head by means of displacing a neighbor of a central portion of a longer side of the ink jet recording head in the designated direction of supplying the recording sheet.

16 Claims, 14 Drawing Sheets

INK JET RECORDING APPARATUS AND INK JET RECORDING HEAD WITH MEANS REDUCING THE AMOUNT OF WARP

BACKGROUND OF THE INVENTION

1. Field of the Invention

The present invention relates to an ink jet recording apparatus and its ink jet recording head, and more particularly to an ink jet recording apparatus which has a full-line type ink jet recording head having a recording area covering one line of a recording medium to be fed in a feeding direction substantially perpendicular to the line and to an ink jet recording head assembly.

2. Description of the Prior Art

Conventionally, as known to be an ink jet recording head used for an ink jet recording apparatus, there are two types of ink jet recording heads; a serial type of ink jet recording head which records information on a recording medium such as a recording sheet by moving its single head assembly perpendicularly to the feeding direction of the recording sheet and a full-line type of ink jet recording head. In the latter type, an ink jet recording head assembly is constructed in the form of a one dimensional array of ink jet discharging orifices covering the substantially full range of recording columns on a recording sheet and each ink jet discharging orifice is linked to an ink jet energy generation device via a liquid passage both of which are also arranged behind the ink jet discharging orifice. In view of the recording efficiency, a full-line type ink jet recording head is more advantageous than a serial type.

FIG. 6 shows an illustrative example of a full-line type ink jet recording head. In FIG. 6, a component 1 is a first plate or a substrate on the surface 1A of which a plurality of ink discharging orifices 2 are arranged with a close pitch and a high density, and furthermore, liquid passages not shown in FIG. 6; are formed on the substrate 1 and are connected to the ink discharging orifices 2, and electro-thermal converting elements used as ink jet energy generation devices and so on. And components 3A and 3B are ink supply tubes supplying ink into a recording head 10, and component 4 is a second plate or a base plate for supporting fixedly the substrate 1. The substrate 1 and the base plate 4 are glued firmly together in an ordinary case by adhesive materials .

So far, the recording head 10 made as described above is mounted in a recording apparatus with its position fixed precisely at an appropriate place. Ink is supplied through ink supply tubes 3A and 3B from an ink supply means not shown in the figure. The recordings are made by making use of thermal energy generated by driving the electro-thermal converting elements used as ink jet energy generating devices in accordance with input recording signals, discharging ink droplets from the ink discharging orifices 2 and then landing the droplets on the surface of a recording sheet which is placed against the discharging orifices 2. And also, for example, by placing four recording heads 10 described above in parallel with one another and by ejecting ink with different colors from each of recording heads, respectively, that is, colors of cyan, yellow, magenta and black, it is possible to establish full-color recording.

In the conventional full-line type of recording heads as described above, however, the length of a recording head in the longitudinal direction is required to get longer as the width of recording sheets get wider, and at the same time, the length of a recording head in the latitudinal direction tends to be taken shorter because a main wafer is sliced into a number of pieces used as a plurality of substrates in view of fabrication and production efficiency. As a result, as shown in FIG. 8B and FIG. 8C, inevitably, the amount of warp of a recording head in the longitudinal direct ion has a tendency to be larger.

In order to reduce the amount of warp, when bonding the first plate or the substrate 1 and the second plate or the base plate 4, in general, the substrate 1 is reinforced by an external force and glued firmly onto the base plate 4 so that the warp in the substrate 1 may be compensated. In many cases, the longer the substrate 1 is in the longitudinal direction, the more difficult and incomplete is the compensation of the warp.

In particular, in the case of making full-color recording by placing a plurality of full-line type recording heads in parallel with one another and by ejecting ink with different colors from each of the recording heads and trying multiple print on the same column spot, due to deviated warp in each recording head, landing positions of ink droplets from ink jet discharging orifices of different recording heads on the same column are not identical on the surface of a recording sheet. As a result, for example, as shown in FIG. 7B, due to a mismatch of landing positions of ink droplets with different colors onto a recording sheet such as so-called color deviations, complex color tones mixed with several color tones each corresponding to an individual recording head can not be reproduced completely. In particular, as shown in FIG. 8B and FIG. 8C, in the case that any pair of recording heads each having warp in opposite directions with respect to each other are mounted in an ink jet recording apparatus, when driving the pair of recording heads and trying perform multiple print on the same line with these recording heads, at the columns at opposite line ends of an array of discharging orifices 2, that is, at the columns on the right and left sides of a recording sheet, ink droplets from both recording heads can be directed exactly to an identical position on the sheet. On the other hand, under the same condition as that described above, in trying multiple print in the neighbor of the central portion of the recording sheet, colored ink droplets can not be directed to an identical position on the recording sheet as shown in FIG. 7B.

As described above, in recording information on a recording sheet by mounting a full-line type recording head having a warp into a recording apparatus, it is difficult to record an exact straight line on the recording sheet. And furthermore, in particular to conventional apparatuses, making use of a plurality of recording heads, each head corresponding to a single ink color, for trying to direct multiple colored ink droplets onto an identical position for full color printing, landing positions of ejected ink droplets on the recording sheet are deviated from a straight line due to warp of the recording head. Especially in the area of the central portion of the recording sheet, it is much more difficult to obtain an exact and uniform matching of landing positions of ink droplets with different colors on the recording sheet. Hence, there was such a disadvantage in the conventional ink jet recording apparatus that complex color tones given by mixing several single color tones are different in positions on the recording sheet and the quality of print was reduced.

SUMMARY OF THE INVENTION

An object of the present invention is to provide an ink jet recording apparatus and its ink jet recording head both of which advance a reduction of the amount of warp of one dimensionally arranged recording heads in the direction perpendicular to the longitudinal directions of the recording heads, insure an exact and uniform landing of ink droplets ejected from different recording heads each of which corresponds to an individual single color tone on the whole recording width of a recording sheet, and provide a high quality of recorded images on the recording sheet.

In the first aspect of the present invention, an ink jet recording apparatus comprises:

means for feeding a recording medium in the form of a sheet in a predetermined direction;

an ink jet recording head having an array of a plurality of ink jet discharging orifices which is arranged in parallel with a surface of the recording medium in the form of a sheet and arranged in a direction perpendicular to the predetermined direct ion; and means for displacing a neighbor of the central portion of the ink jet recording head in the predetermined direction Here, a plurality of the ink jet recording heads may be arranged in the predetermined direction.

The ink jet recording head may be composed of:

a first plate in which ink discharging orifices are formed;

a second base plate shaped in rectangular parallelpiped being bonded to the first plate.

The displacing means may comprise;

a mount base member connected to the second base plate at opposite ends thereof, a predetermined space being formed at the center of the mount base member between the second base plate and the mount base member;

a supporting member fixed to the mount base member;

an adjustment screw mounted into the mount base member for contacting a surface of the primary base board; and an adjustment screw mounted into the supporting member for contacting a surface of the first plate.

The displacing means may comprise;

a mount base member linked to the second base plate at opposite ends thereof, a predetermined space being formed at the center of the mount base member between the second base plate and the mount base member;

a supporting member fixed to the mount base member;

means, placed in the predetermined space, for applying a first external force against the second base plate; and an adjustment screw mounted into the supporting member for contacting a surface of the first plate.

The ink jet recording head may discharge ink by means of thermal energy and may include electro-thermal conversion elements for generating thermal energy.

In the second aspect of the present invention, an ink jet recording head comprises:

a first plate having a plurality of ink jet discharging orifices arranged in the longitudinal direction of the first plate and means for discharging ink;

a secondary base plate, formed in a rectangular parallelpiped and contacting and supporting the first plate.

A thickness of the second base plate at the center and at opposite ends of the second base plate is different, facilitating a correction of a warped shape of the ink jet recording head.

Here, the thickness of the second base plate may be formed to be the smallest at the center of the second base plate.

The ink jet recording head may discharge ink by means of thermal energy and may include electro-thermal conversion elements for generating thermal energy.

In the third aspect of the present invention, an ink jet recording head unit, comprises;

a plurality of recording heads arranged in parallel to one another, each recording head having an array of ink discharging orifices covering substantially a whole width of a recording medium so as to record on the recording medium;

means for exchanging heat, the means comprising a first heat exchanging portion, contacting each of the recording heads for exchanging heat therebetween and a second heat exchanging portion, extending from the first heat exchanging portion, for exchanging heat between atmosphere and the second heat exchanging portion,thereby enabling an adjustment of the temperature of the recording heads;

means for supporting the plurality of recording heads on a predetermined position at opposite ends of each recording head;

means for adjusting an amount of warp of each recording head so as to equalize intervals between adjacent recording heads, the means being engaged with the recording heads in the substantially center portion in the longitudinal direction thereby and pressing the recording heads in a direction perpendicular to an ink discharging direction and the longitudinal direction.

In the present invention, using a means for adjusting the amount of warp of one dimensionally arranged recording heads mounted on an ink jet recording apparatus, applying an external force corresponding to the amount of warp of the recording heads in the direct ion for compensating the warp of the recording heads, it is possible to correct a warped shape of the recording heads and to form an array of the recording heads in a straight line geometry. In this manner, it is possible to remove the warp of the recording heads of a full-line type and hence, to provide a precise landing of ink droplets on the recording sheet and a high quality of recorded images on the recording sheet.

Furthermore, in the existence of a warp of recording heads mounted in an ink jet recording apparatus, it is possible to adjust easily the amount of the warp of the recording heads within a predetermined value and hence to advance an establishment of forming exactly a straight line geometry of the one dimensionally arranged recording heads. In particular, in the case of making full-color recording by means of a plurality of full-line type recording heads in parallel with one another and by discharging or ejecting ink with different colors from each of the recording heads, respectively, and trying multiple print on the same column spot, at the whole range of recording columns on the recording sheet, reduced is a mismatch of landing positions of ink droplets with different colors and attained is an exact and uniform matching of landing positions of ink droplets with different colors on the recording sheet and complex color tones are equalized so that it is possible to provide a high quality of recorded images on the recording sheet. In addition, as there is no need for adjusting the amount of warp of a recording head within a predetermined amount at a fabricating process of the recording head, it is possible not only to make the fabricating process of the recording head simpler but also to attain a higher yield percentage of fabricated recording head assemblies.

The above and other objects, effects, features and advantages of the present invention will become more apparent from the following description of embodiments thereof taken in conjunction with the accompanying drawings.

BRIEF DESCRIPTION OF THE DRAWINGS

Embodiments of the invention will now be described, by way of example and with reference to the accompanying drawings in which like parts are designated with like numerals throughout, and in which.

DETAILED DESCRIPTION OF PREFERRED EMBODIMENTS

As will be described, these and other features of the present invention and one embodiment of it are more fully described below in the detailed description and with the accompanying drawings.

Figure 1B:
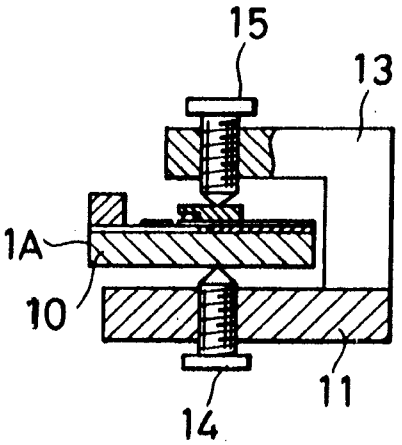
FIGS. 1A and 1B are a front view and a cross sectional view taken along lines A–A showing a structure of a mount base of a recording head in one embodiment of the present invention.
Figure 1A:
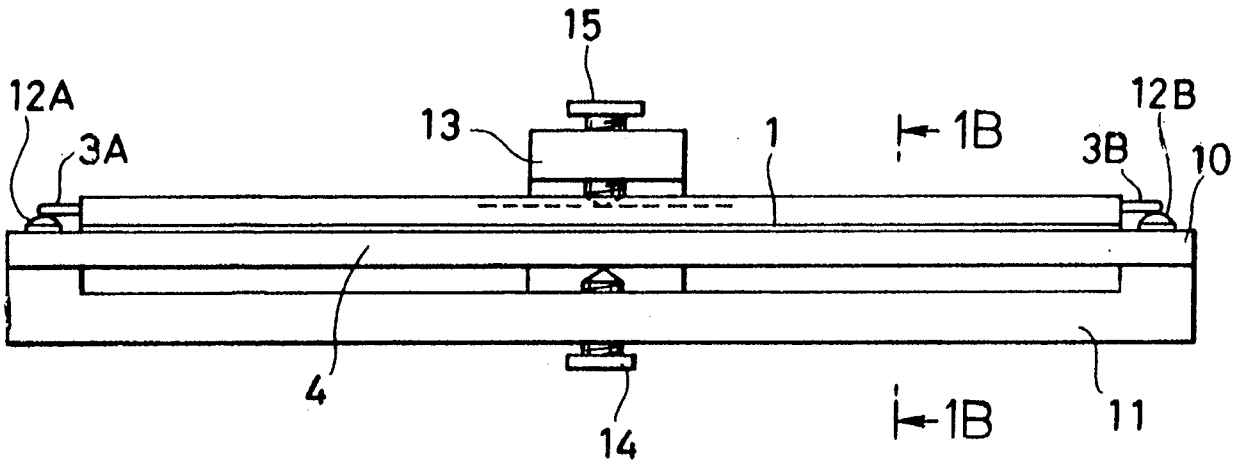

FIG. 1A and FIG. 1B illustrate a diagrammatic representation, as one embodiment of the present invention, of an ink jet recording head and a means for adjusting the amount of a warp thereof. In these figures, a component 11 is a mount base for mounting or supporting a recording head 10 into a designated position in an ink jet recording apparatus, components 12A and 12B are fixing screws for fixing the recording head 10 onto the mount base 11 at opposite ends of the recording head 10, a component 13 is an arm member with its base fixed to the center of the mount base 11 and with its top striding over the recording head 10, and components 14 and 15 are fine adjustment screws mounted into screwed holes in the mounted base 11 and the arm member 13, respectively, with their axes meeting together and with their screw tops contacting opposite faces of the recording head 10.

Figures 8A, 8B, 8C:
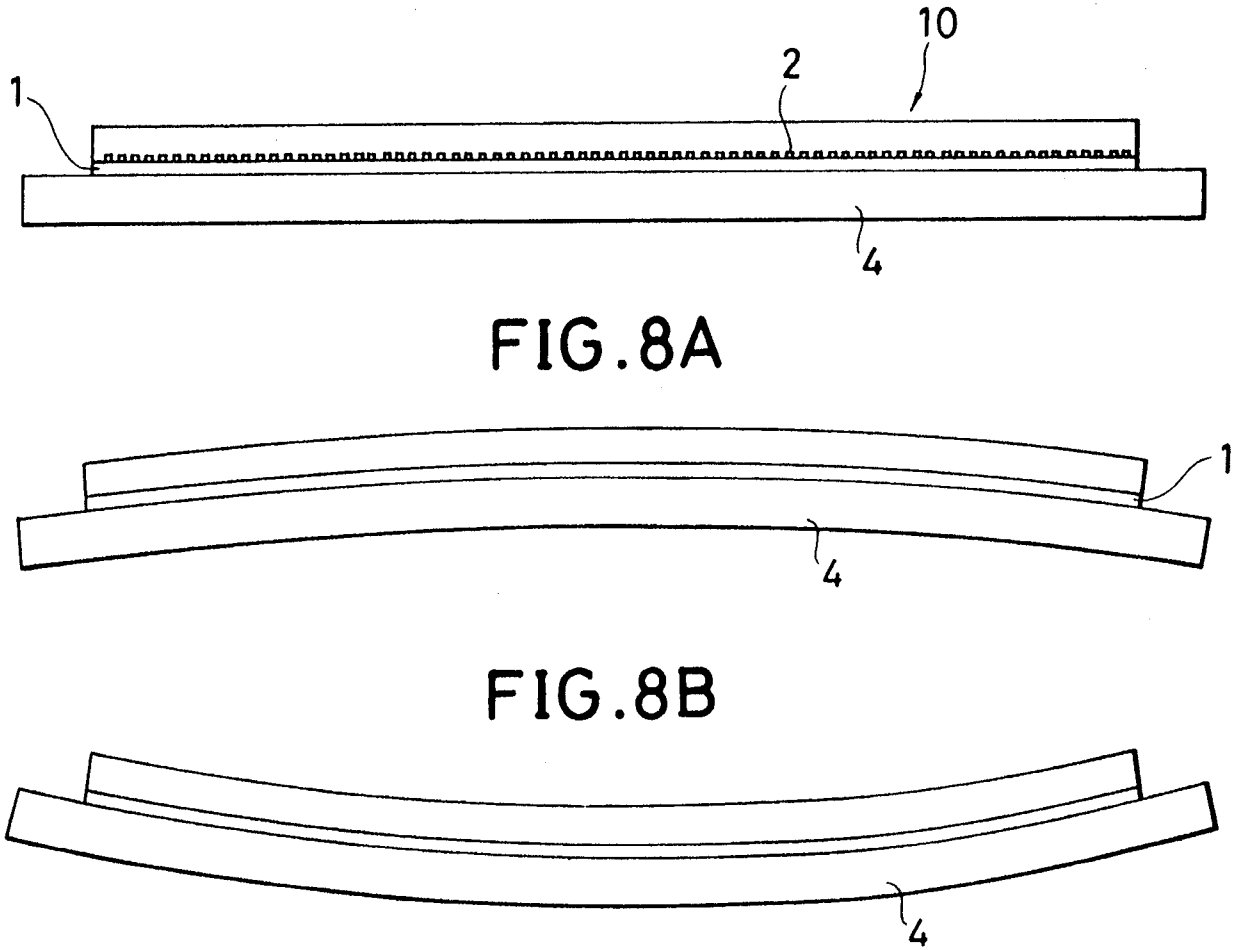
FIGS. 8A, 8B and 8C illustrate conditions of warps generated in recording heads.

In other words, these fine adjustment screws 14 and 15 are mounted in the mount base 11 and its arm member 13 in the form as shown in FIGS. 1A and 1B. By means of screwing up or down both of the fine adjustment screws 14 and 15, the amount of a warp or bend of the recording head 10 in the direction perpendicular to its longitudinal direction is varied and hence a warped shape of the recording head 10 can be corrected so as to maintain the shape of the recording head 10 to be a straight line shape as shown in FIG. 8A. In this embodiment, the fine adjustment screws 14 and 15 are placed at the center on the longer side of the recording head 10 because the amount of a warp of the recording head 10 has its maximum value at the center of the longer side of recording head 10. A plurality of fine adjustment screws may be placed at several points on the recording head 10 in order to attain more precise adjustment of warp over the longer side of the recording head 10.

Figure 2:
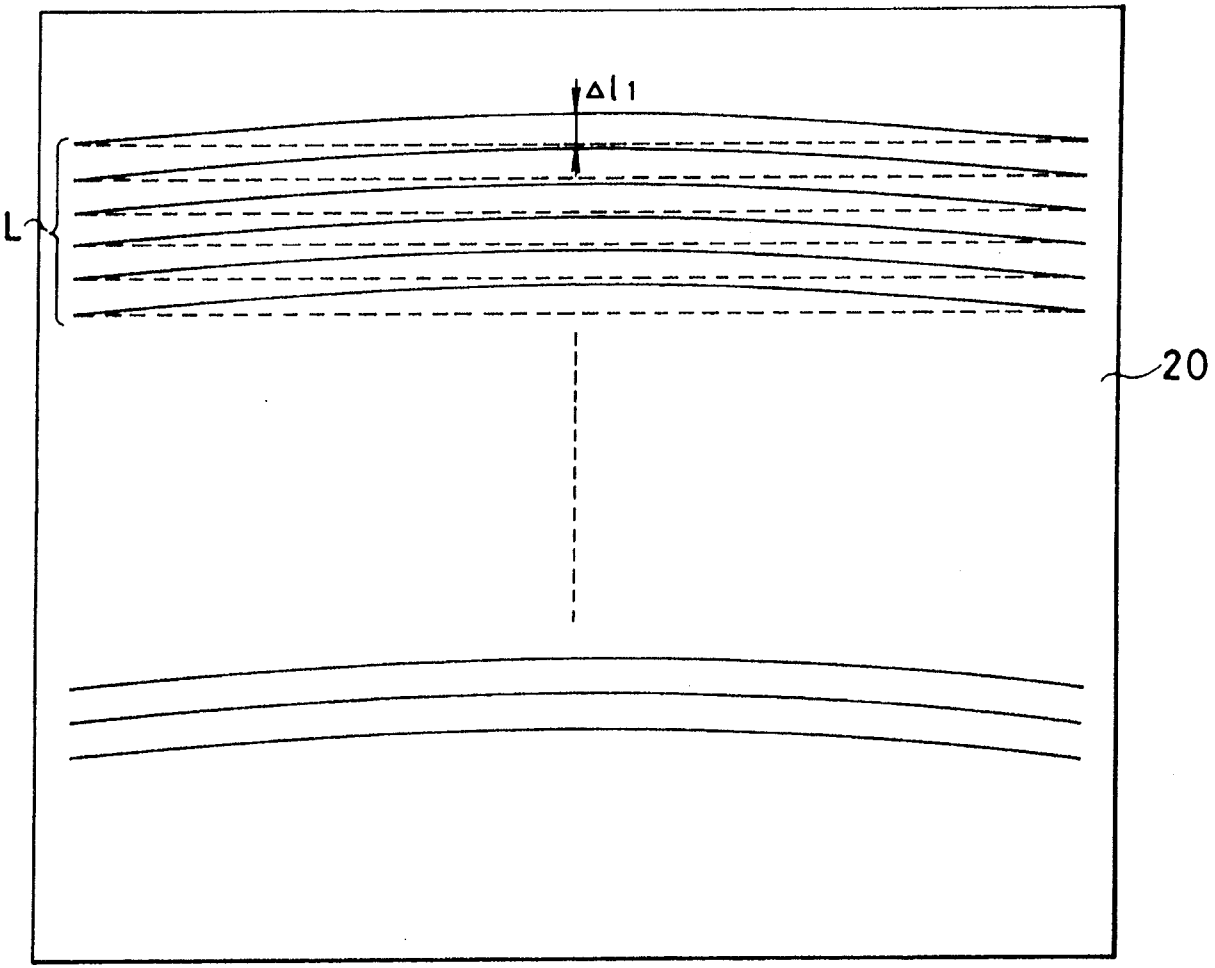
FIG. 2 is a diagrammatic illustration of a recording pattern for measuring an amount of a warp of a recording head.

As for a typical adjustment method using fine adjustment screws 14 and 15, an adjustment work is carried out in the following steps;

(1) screwing down both fine adjustment screws 14 and 15 so as to make the recording head 10 free from an external force, (2) accomplishing full-line recording on a recording sheet with some dot intervals on each line with the recording head 10, (3) observing an amount of warp $\Delta l1$ of a recorded line L and its shape, that is, convex or concave with respect to the reference straight line shown by the broken line in FIG. 2, (4) if the warp shape is convex in the upper direction on the recording sheet, then screwing up the fine adjustment screw 15 so as to compensate the amount of warp $\Delta l1$ and (5) repeating (1) through (4) until the amount of warp of the recording head 10 reaches within a predetermined allowance value.

So far, repeating trial-and-error works with the fine adjustment screws 14 and 15, at the state that the amount of warp of the recording head 10 is settled within a predetermined allowance value, both of the fine adjustment screws 14 and 15 are fixed so that tops of both screws 14 and 15 may be contacted tightly together on the surfaces of the recording head 10.

The description above refers to the case that one recording head is used as an embodiment of the present invention. The following description will be directed to the case that a plurality of recording heads are used to accomplish full-color recording in a color ink jet recording apparatus.

Figure 3:
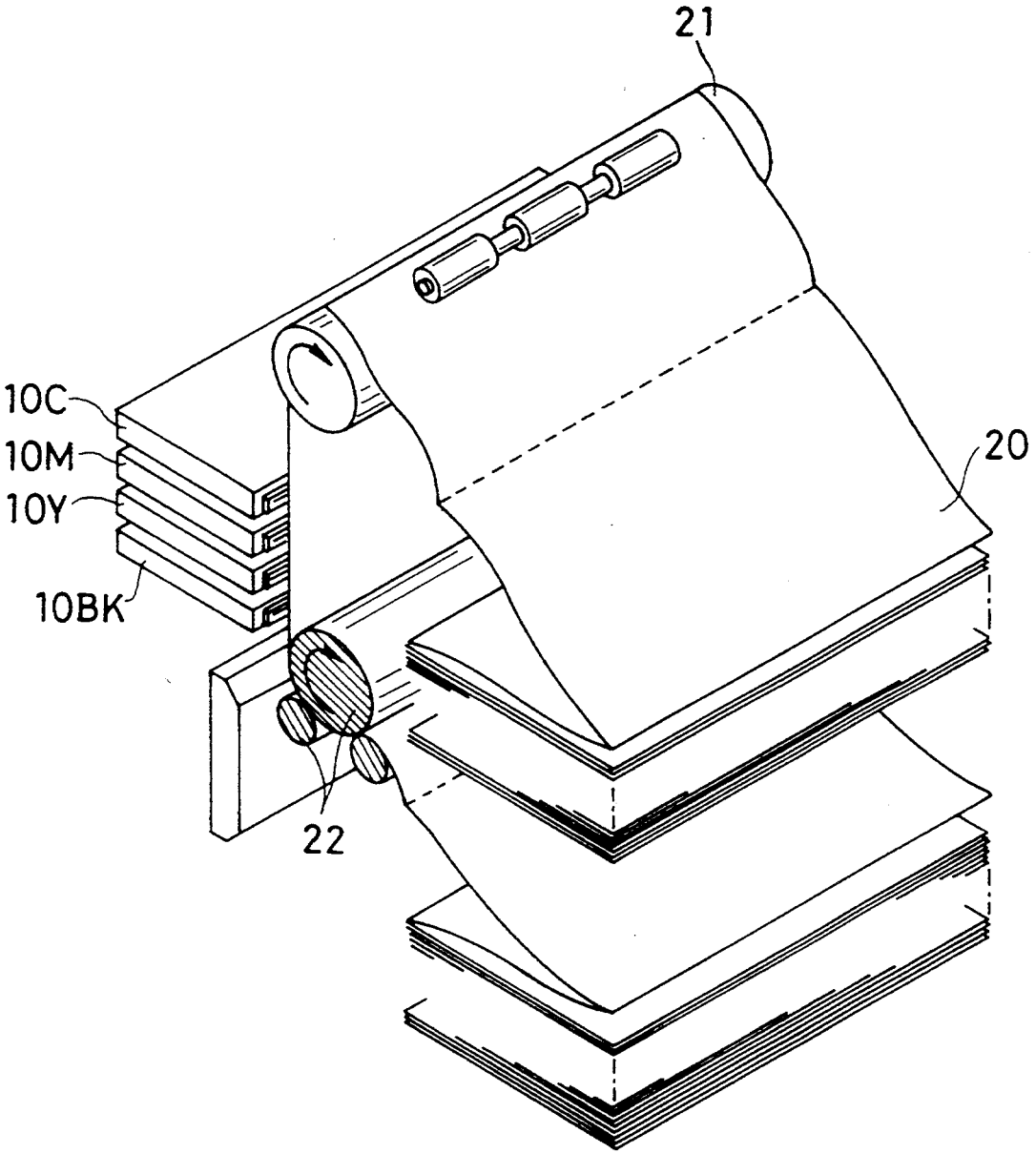
FIG. 3 is a perspective view of an ink jet recording apparatus provided with a plurality of recording heads as used in the present invention.

FIG. 3 shows a diagrammatic illustration of an ink jet recording apparatus as used in another embodiment of the present invention, where four recording heads are used. Referring now to FIG. 3, components 10C, 10M, 10Y and 10BK are four recording heads, each of the recording heads corresponding to ink colors of cyan, magenta, yellow and black, respectively. Each of recording heads 10C, 10M, 10Y and 10BK is mounted on a mount base 11 containing fine adjustment screws both shown in FIG. 1 though it is not illustrated in FIG. 3. Components 21 and 22 are sheet feed rollers for feeding a continuing recording sheet 20.

The following are steps in an adjustment work done for optimizing the amount of warp of four recording heads used in full color printing;

(1) selecting one of four recording heads 10C, 10M, 10Y and 10BK, (2) accomplishing full-line recording on a recording sheet with some dot intervals on each line as shown in FIG. 2 with the selected recording head, (3) observing an amount of warp Δl1 of a recorded line L and its shape, that is, convex or concave with respect to the reference straight line shown in broken line in FIG. 2, (4) as described earlier, screwing up and down the fine adjustment screws 14 and 15 so as to compensate the amount of warp Δl1, (5) repeat (1) through (4) until the amount of warp Δl1 of the selected recording head reaches within a predetermined allowance value and if the amount of warp is optimized then the adjustment work continues to the following step for optimizing the amount of warp of the other three recording heads.

With an adjusted recording head and the other three recording heads, 10C, 10M 10Y and 10BK, trying multiple color print on a full line and with sampled dots, there might be deviations of landing positions of colored ink droplets in a sheet feeding direction on a recording sheet, as shown in FIG. 2 before. In order to correct the warped shape of the other three recording heads, fine adjustment screws of the other three respective recording heads are screwed up or down so that each recorded line of the other three recording heads overlap the recorded line of the above selected recording head.

In the case of using a recording head fabricated beforehand with its warp amount fixed within a predetermined allowance value, a recorded line made by this recording head, for example, corresponding to black-colored ink, may be used as a reference to adjust the warped shape of the other three recording heads corresponding to ink colors of cyan, magenta and yellow.

Figure 4B:
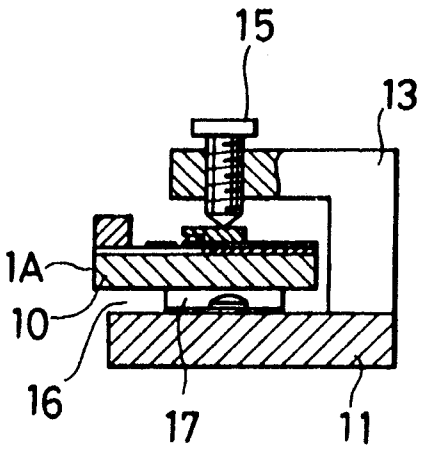
FIGS. 4A and 4B are a front view and a cross sectional view taken along lines A–A for showing a structure of a mounting base of a recording head in other embodiments of the present invention.
Figure 4A:
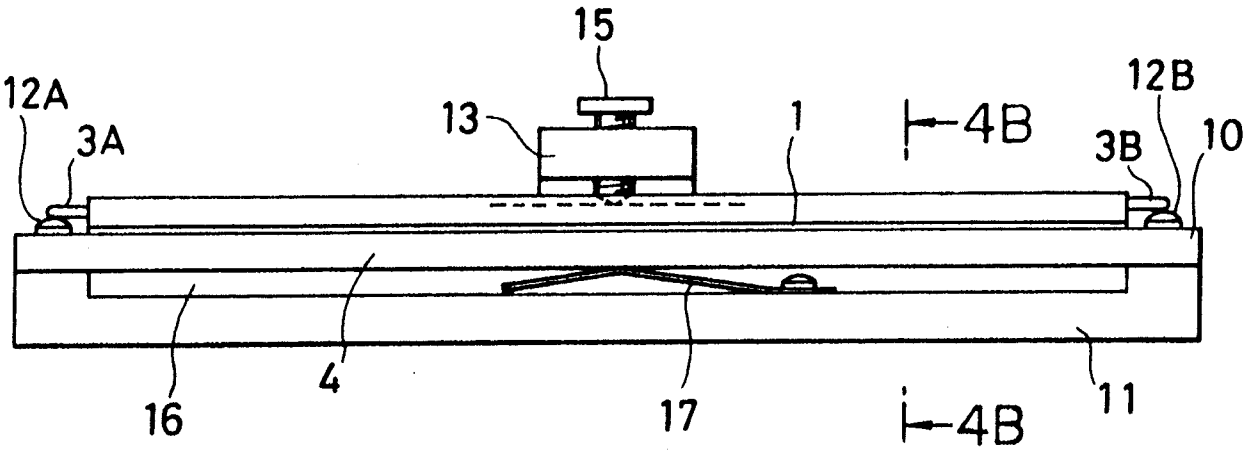

FIG. 4A and FIG. 4B show another embodiment of the present invention utilizing a means for adjusting the warped shape of an ink jet recording head. In this embodiment, substituting for a fine adjustment screw 14 placed between the recording head 10 and the base mount 11 as shown in FIGS. 1A and 1B, a bent leaf spring 17 is mounted in a space 16 between the recording head 10 and the base mount 11. A reactive force generated by the leaf spring 17 is directed to the central portion of the recording head 10 at the bottom surface thereof so that a firm contact between the top of the fine adjustment screw 15 and the upper surface of the recording head 10 is established. Therefore, in this embodiment, by means of screwing up or down only the fine adjustment screw 15 and combining a reactive force by the leaf spring 17 and an external force corresponding to a displacement of the fine adjustment screw 15, a shape of the recording head 10 can be altered.

Thus, in the present invention, by applying an external force at the center of the recording head in the longitudinal direction , a warped shape of the recording head can be corrected effectively. Therefore it is desirable to select a material and form a structure of the recording head so as to be flexible or deformable in the direction perpendicular to the directions of the ink ejecting direction and the longitudinal direction of the head subject to an external force.

Figure 5A:
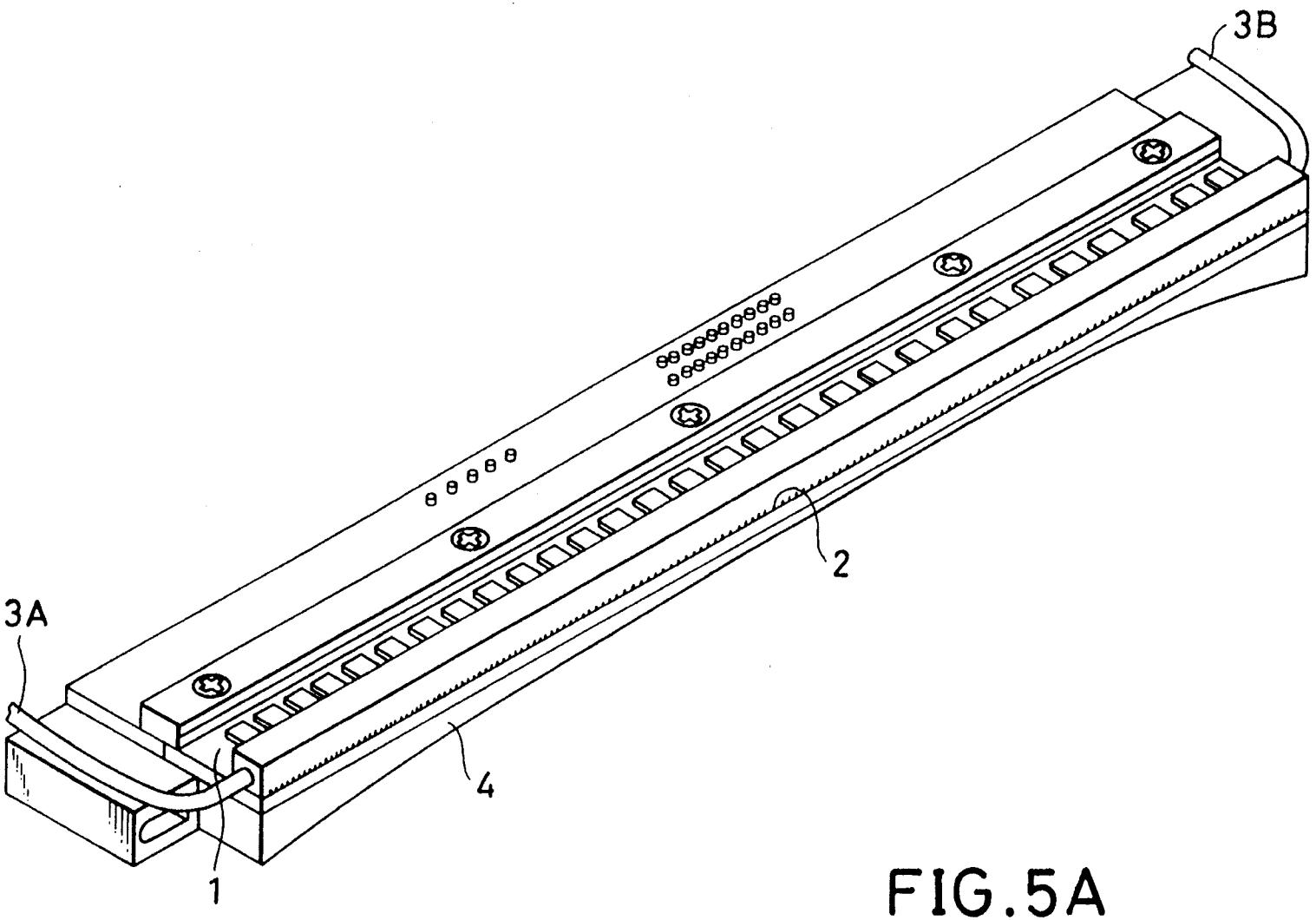
FIGS. 5A, 5B and 5C are perspective views of example structures of recording heads as used in the present invention.
Figure 5B:
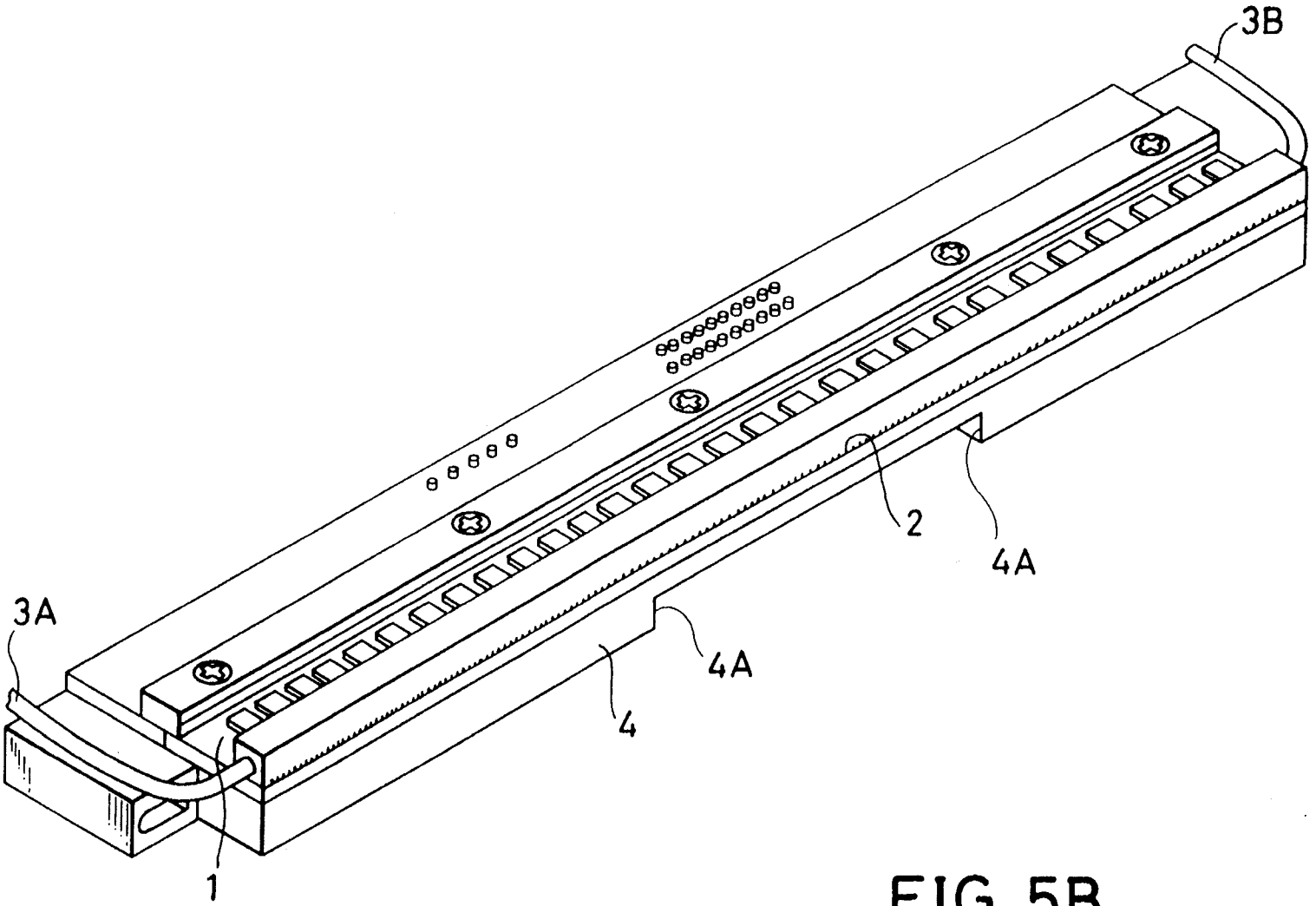
Figure 5C:
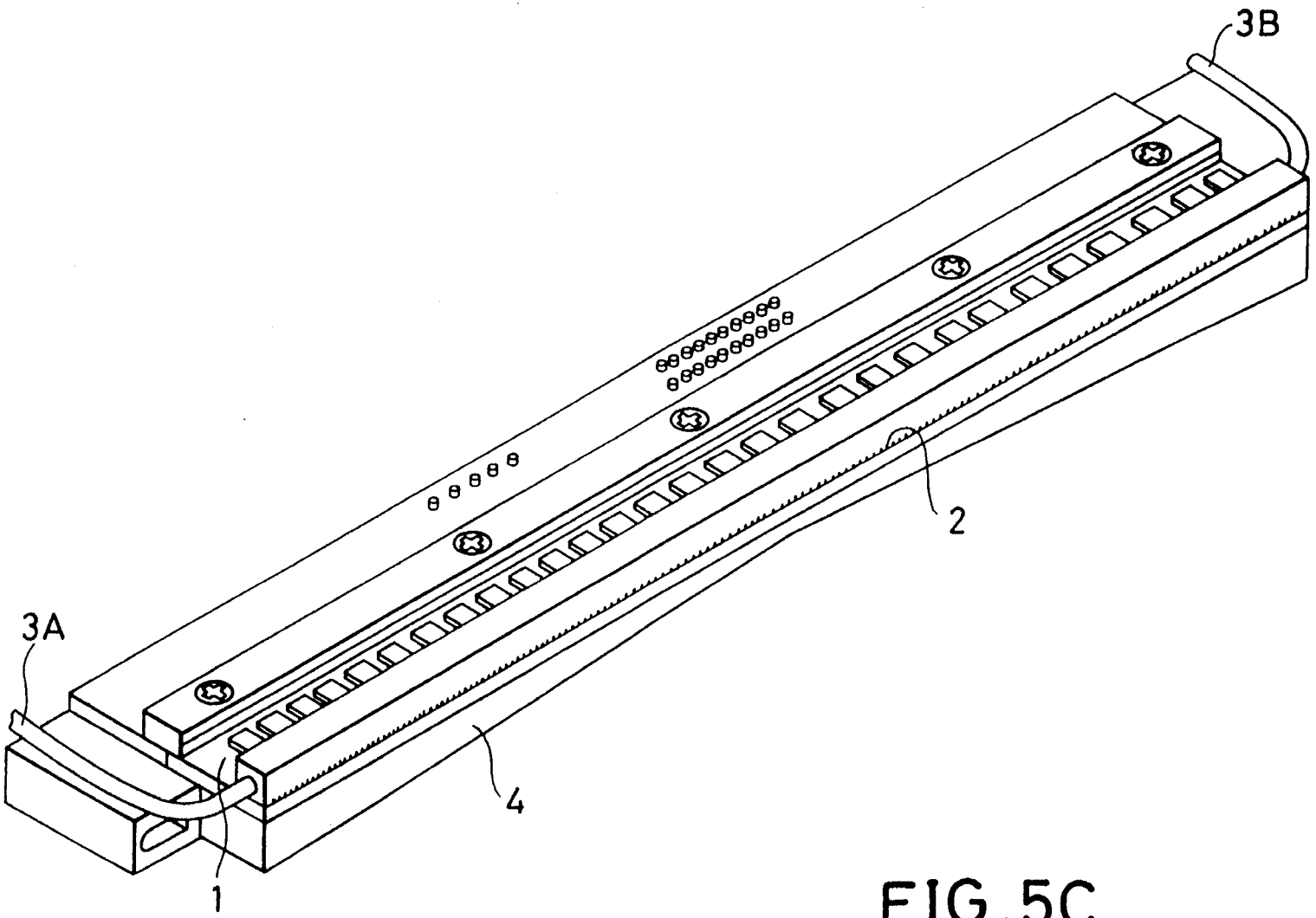

FIGS. 5A through 5C illustrate other embodiments of recording heads as used in an ink jet recording apparatus of the present invention. In these embodiments, a secondary plate or a base plate 4, on which a first plate or a substrate containing a plurality of ink jet energy generation devices arranged in a one dimensional array in the longitudinal direction of the recording head 10 is firmly supported, is formed to be flexible subject to an external force so as to be easily warped. Referring to FIG. 5A, the thickness of the base plate 4 varies smoothly along its longitudinal direction such that the thickness of the plate 4 takes its smallest value at the longitudinal center thereof and takes its largest value at opposite ends of the base plate 4. FIG. 5B shows another embodiment of a recording head where the thickness of the base plate 4 in the longitudinal direction is reduced in a stepwise manner toward the center of the base plate 4 by making steps 4A, 4A. Further referring to FIG. 5C illustrating another embodiment of a recording head, the thickness of the base plate 4 in the longitudinal direction thereof is reduced gradually and linearly towards the center of the base plate 4. The preferred embodiments of the shape of the base plate 4 as described here are not restrictive as a form of flexible structure for adjusting a warped shape of a recording head.

As for an ink jet recording head formed as described above, it will be appreciated that a warped shape is easily corrected by means of applying an external force with less intensity at the longitudinal center of the ink recording head, where the thickness of the base plate 4 is smaller than that at opposite ends of the base plate 4.

Next, referring to FIG. 9 through FIG. 15, there is shown a more preferred embodiment of the present invention. In the following embodiment, involved are a combined form of two inventions; an invention directed to a color ink jet recording apparatus employing a temperature adjustment mechanism by means of heat exchangers and an invention directed to a recording head assembly where a plurality of full-line type ink jet recording heads are arranged so as to keep an adequate allowance of distance between two adjacent recording heads without increasing memory size.

The following embodiment refers to such a structure of a color ink jet recording apparatus that has a plurality of ink jet recording heads, in each ink jet head an array of ink discharging orifices is arranged covering the full range of recording columns on a recording sheet and has a heat pipe in each recording head assembly, a heat pipe being placed along with the recording heads for exchanging heat between them.

Recording heads are arranged so that a distance between any two adjacent recording heads parallel to each other may be kept to a designated value. However, because the length of a longer side of recording heads, i.e., the length measured in the direction of an array of ink discharging orifices, is long, and a heat pipe is supported by and bonded onto its corresponding recording head, such a case is often found that the shape of a recording head is warped and the amount of warp in the central portion of the recording head in the longitudinal direction thereof greater than the amount of warp of the recording head itself.

Therefore, the mechanism of adjusting the amount of warp of the recording head which is discussed previously brings a satisfactory effect in the former invention. In the previous mechanism of adjusting the amount of warp of the recording head, as mechanical components of this mechanism are wholly placed between adjacent recording heads, it is inevitable to form a large-sized recording head assembly where a plurality of recording heads are arranged parallel to one another at wider intervals.

In contrast with the above case, in the following embodiment, a structure of adjustment is employed so that an external force for compensating a warped shape of a recording head can be applied not linearly but with a nonlinear curve.

By this way, it is possible to adjust a distance between adjacent recording heads to be a desired value, and to establish a small-sized assembly of an ink jet recording apparatus.

Figure 9:
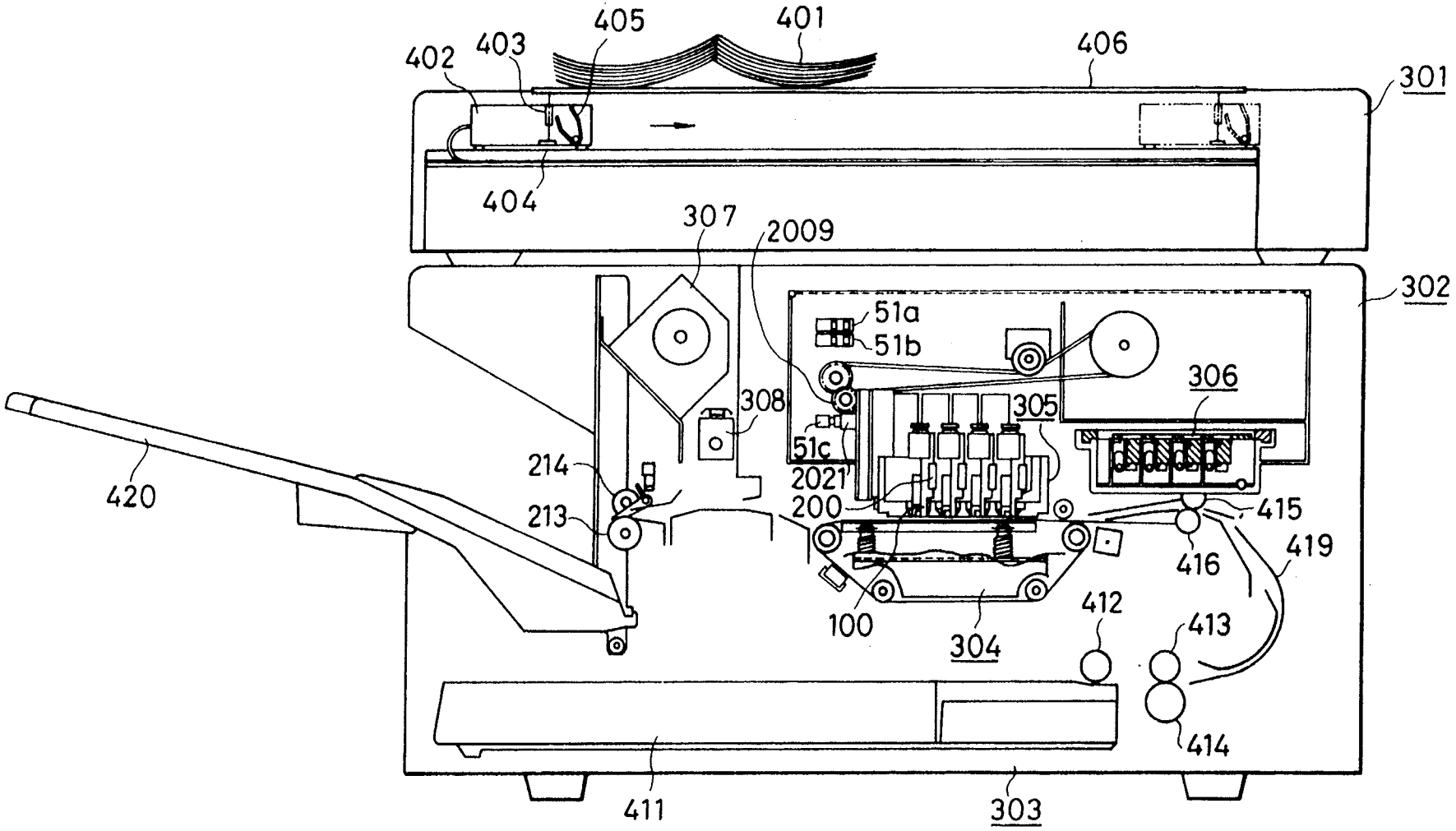
FIG. 9 is a diagrammatic front sectional view of a copy machine using an ink jet recording apparatus as its recording part, of one embodiment according to the present invention.

FIG. 9 is a diagrammatic front sectional view of a copy machine using an ink jet recording apparatus, as its recording part, of one embodiment according to the present invention.

A component 301 is a scanner portion for reading visual image information printed on a sheet and transforming it into electrical signals.

A component 302 is a recording portion enabling recording of visual information on a recording medium such as a recording paper sheet according to electrical signals obtained at the scanner portion 301 as well as having a function such as a facsimile or a printer enabling recording of visual information by receiving electric signals from external information processing host machines.

In detail of the scanner portion 301, a component 401 is a manuscript including visual image information, and a component 406 is a table on which the manuscript 401 is placed and is made of transparent glass. A component 402 is a manuscript reading unit for reading visual images involved in the manuscript 401.

In the manuscript reading unit 402, mounted are a rod array lens 403, an equalized-spectrum decomposition type line reading sensor (a color image sensor) 404 and an exposure means 405. When a manuscript reading unit 402 moves in the direction as shown by an arrow in FIG. 9 by the aid of a move and scan mechanism not shown in FIG. 9 in order to read visual images involved in the manuscript 401 placed on the table 406, an exposure lamp forming the exposure means 405 in the manuscript reading unit 402, is turned on, the reflected light from visual images on the manuscript 401 exposed by the light from the exposure lamp is collected through the rod array lens 403 and led to the equalized-spectrum decomposition type line sensor, which will be called image read sensor in the rest of description of the present invention.

In the image read sensor 404, color image information of the manuscript 401 containing mixed color tones is detected by single color components, red (R) , green (G) and blue (B) and electric digital signals corresponding to each color component are generated. These digital signals as recording data are transferred to the recording portion 302.

In the recording portion 302 a component 305 is a recording head portion having the so-called full-line recording heads 100, each recording head, corresponding to each single color tone ink, that is, yellow, magenta, cyan and black, on which an array of ink discharging orifices is formed over the whole range of the recording width of a recording medium.

Figure 10:
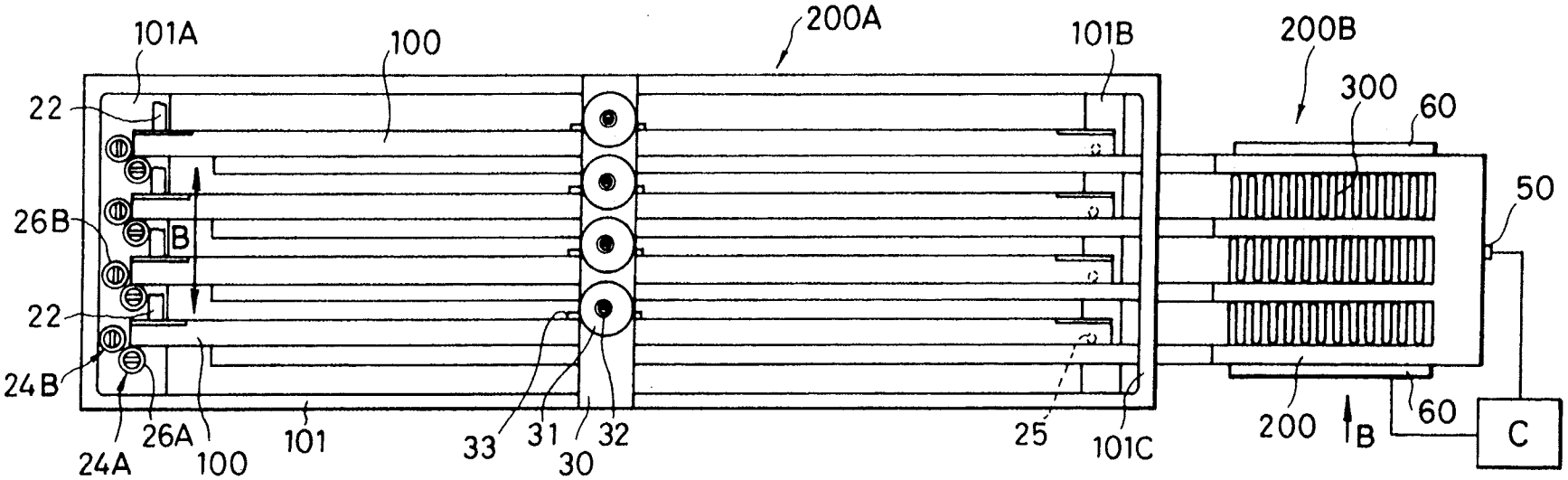
FIG. 10 shows a plan view of a recording head unit of a further embodiment according to the present invention.
Figure 14:
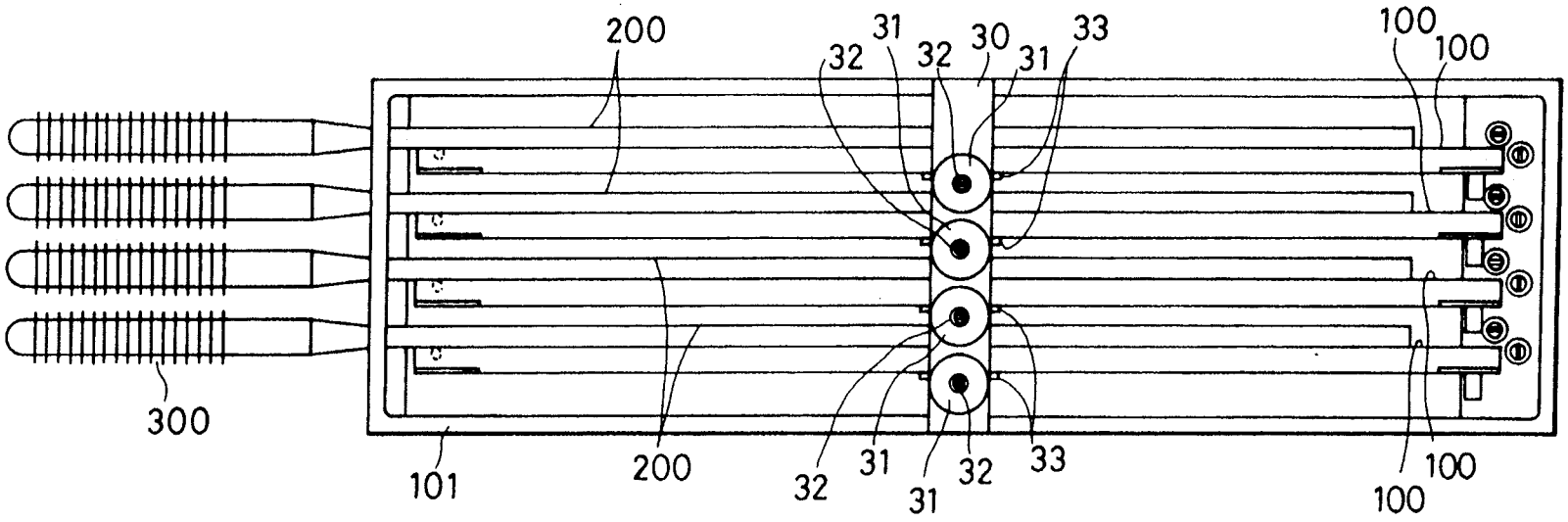
FIG. 14 shows a plan view of a recording head unit of a still further embodiment according to the present invention.

In addition, corresponding to each recording head, a heat pipe is placed beside the recording head, in order to adjust temperature of the recording head by removing heat generated therein. As for some embodiments of a heat pipe, two types of finishing ends structure of a heat pipe are applicable: a type as shown in FIG. 10 where all the ends of heat pipes are connected to a unit and a type as shown in FIG. 14 where all the ends of heat pipes are separated from one another. A component 306 is a recovering apparatus portion including recovery caps, moving relatively to a space between the rising recording head portion 305 and a recording sheet feeding mechanism for forming a recording region in order to cover a surface of a discharging portion of a recording head. Using recovery caps 306, an ink discharging characteristic of a recording head is maintained to be better by preventing dryout of ink and pre-discharging of ink.

In using the recording head under the uncapped condition in such a case as recording information, the recording head portion 305 is placed in the opposite position to a feed path of recording sheets as shown in FIG. 9. Movement of the recording head portion 305 and the recovering apparatus portion 306 are controlled by using signals from sensors 51*a*, 51*b* and 51*c* and by actuating a driving gear 2009 and a detected positioner 2021 and so on. A component 303 is a sheet feeding portion, having a cassette 411 for storing and piling recording sheets and a pickup roller 412 for separately supplying a recording sheet stocked in the cassette 411.

A recording sheet is fed into a feed path 419 by a pair of feed rollers 413 and 414, and furthermore, forwarded to the position opposite to the surface of a discharging portion of the recording head portion 305 by a pair of resist rollers 415 and 416 for coordinating sheet feed timing. A sheet feed path, located in the position opposite to the surface of the discharging portion, is formed by a belt feed portion 304. In other words, the belt feed portion 304 includes an endless belt running in a sheet feeding direction that attracts a recording sheet by electrostatic force and forms a recording position opposite to the surface of a discharging portion of the recording head and a drive portion for driving the endless belt.

The recording sheet having passed at the recording position is forwarded by the belt feed portion 304 from the recording position opposite to the recording head portion 305 further to a sheet outlet. While the recording sheet passing through a feed path as described above, the surface of the recording sheet is blown by air heated by an infrared heater 308. Owing to the air blown on the recording sheet, a firm fixation of ink on the surface of the recording sheet is established by promoting evaporation of moisture content in ink droplets.

The recording sheet arriving at the sheet outlet is discharged onto a hopper tray 420 by means of a pair of discharge rollers 213 and 214.

Figure 11:
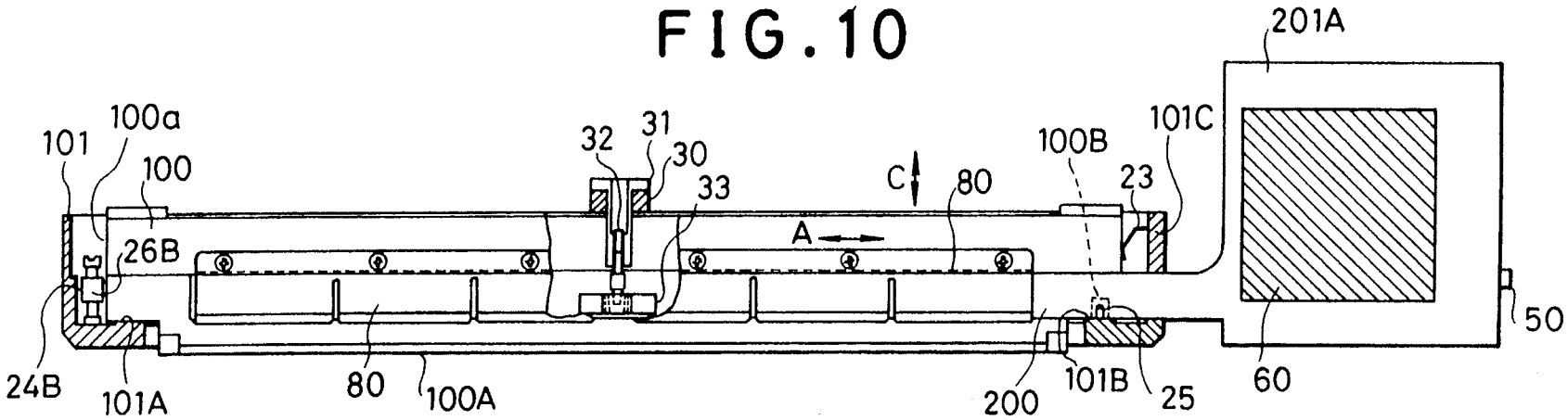
FIG. 11 shows a side sectional view of a recording head unit shown in FIG. 10.

In FIGS. 10 and 11, a component 100 is one of the so-called full-line type recording heads having a recording area over the whole range of a recording region on a recording sheet. In the recording head used in the embodiment of the present invention, 4736 ink discharging orifices are arranged at intervals of 63.5 μm so as to attain a recording density of 400 bpi (bit per inch) and to record information on the sheet of A3 size whose dimension is regulated by Japanese Industrial Standard.

A liquid passage communicating with each ink discharging orifice, respectively, has an electro-thermal conversion element. Making use of thermal energy generated by the electro-thermal conversion element, giving a temperature rise in ink neighboring around the electro-thermal conversion element at a higher rate for causing film boiling in ink, and further using a pressure rise in ink accompanied with the bulb generated by film boiling, an ink droplet is discharged from the ink jet outlet port.

A component 200 is a heat pipe bonded to each recording head 100 at the almost whole region of a longer side face of the recording head except some designated regions used for other purposes. Each heat pipe 200 forms an almost right square part 201A at a region in a heat pipe where the heat pipes do not contact a recording head.

The square part 201A forms a reservoir connecting an end of a heat pipe. Each end portion of the square parts 201A is formed integrally so as to allow communication for fluid inside. This configuration makes it easier to establish a mechanism for controlling temperature of fluid in a heat pipe. Between adjacent square parts 201A, fins made of aluminum in the shape of corrugation are secured. So far, formed are a first heat exchange portion 200A for exchanging heat between the heat pipe 200 and the recording head 100 and a second heat exchange portion 200B positioned apart from and outside of a recording region containing recording heads.

A heat pipe 200 and 201A is composed of a body and working fluid contained in the body. In view of heat conductivity, easiness of processing and manufacturing cost, the body is made of aluminum and working fluid is liquid chloro-fluoro carbon.

In the embodiment of the present invention, in order to attain a higher efficiency in heat exchange, a cross sectional shape of the heat pipe 200, which forms a first head exchange portion 200A for exchanging heat between a heat pipe 200 and the recording head 100 by way of heat transmission, is taken to be substantially rectangular and a shape of a heat pipe 201A forming a second heat exchange portion 200B being used mainly for heat radiation is taken to be substantially right square with its thickness equal to that of the heat pipe 200.

A recording head 100 and a heat pipe 200 are linked with a pressing member 80. A pressing member 80 is a flat spring used for bonding the recording head 100 and the heat pipe 200 by pressing the heat pipe 200 at the whole region of the heat pipe 200 contacting to one longer side, preferably a side formed by a metal base plate, of the recording head 100.

In the pressing member 80, some slits are formed. These slits are used for pressing the heat pipe 200 against the recording head 100 with uniformly distributed pressing force over the whole range of the pressing member 80. By this structure of the pressing member 80, heat transmission between the recording head 100 and the heat pipe 200 is attained uniformly over the whole region of the recording head 100 and at the same time, the structure makes it easy to attach and detach the heat pipe 200.

As for a material used for the pressing member 80, it is preferable to employ an elastic material such as stainless steel (SUS) and phosphorus bronze and to take its thickness to be from 0.2 mm to 1.0 mm. As the thickness of the pressing member 80 contacting directly to the heat pipe 200 is very small, a heat resistance problem can be negligible in the pressing member 80.

Referring again to FIGS. 10 and 11, a component 50 is a temperature sensor which can be formed by thermisters and so on and is placed in the central region which forms the second heat exchange portion 200B and an integrated reservoir for four heat pipes. A component 60 is a plane heater, which is attached to the side faces of two heat pipes located at the outer positions. C is a controller for operating the plane heater 60 by request. The temperature sensor 50 used in the embodiment of the present invent ion is a PCB type thermister taking the shape of a small piece of pellet having a diameter of 1.5 mm and a thickness of 2.5 min. As in the case of the embodiment of the present invention, heat pipe 200 and 200A is a so-called integrated type heat pipe where a plurality of heat pipes are connected to one another at one end of the heat pipes and a working fluid is shared by the heat pipes, by means of a single unit of a temperature sensor 50, a temperature of a working fluid conveying heat removed from four recording heads can be measured directly, and in this case, the position where the temperature sensor 50 is mounted is the midst of a working fluid reservoir collecting working fluid transported through individual heat pipes 201A.

In FIGS. 10 and 11, components 22, 23, *24a*, *24b* and 25 are used for adjusting registration of a recording head 100 and components 30 through 33 are used for adjusting the amount of warp of the recording head. Structure and function of these components will be described later in detail by referring to FIG. 10, FIG. 11, FIG. 12 and FIG. 13.

The recording head 100 have, in its recording head portion, a top plate 106 in which are formed liquid passages, discharging orifices 105, and a common liquid chamber, a heater board 107 having electro-thermal converting elements and an aluminum base plate 108 for supporting the heater board 107 are well known. The base board 108 has an extended portion which firmly contacts a heat pipe 200 and forms an aluminum base plate where various kinds of adjusting mechanisms work.

Referring to FIGS. 10 and 11, a further embodiment of the present invention will be described.

In FIGS. 10 and 11, a component 101 is a housing for supporting a plurality of recording heads as well as a plurality of heat pipes 200 attached beside the recording heads 100. Components 101A and 101B are positioning faces on which opposite ends of each recording head 100 are placed in order to fix the position of a recording head in the direction as shown by arrow C. A head positioning pin 25 is placed on one positioning face 101B which is located on the side that a heat pipe 200 is restricted by a housing side wall 101C. By means of fixing the head positioning pin 25 into a hole 100B which is bored in the recording head 100 and has a longer diameter in the direct ion as shown by arrow A, the position of one end of the recording head 100 is fixed.

A component 22 is a pressing spring which is fixed to the housing 101 and used for restricting the position of the recording head 100 in the direction as shown by arrow B by contacting a side face of one end of the recording head 100. A component 23 is also a pressing spring which is fixed to housing side wall 101C and used for restricting the position of the recording head 100 in the direction as shown by arrow A by contacting an end face of one end of the recording head 100. Components 24A and 24B are eccentric rollers rotatably mounted on the positioning face 101A about their axes perpendicular to the face 101A. These rollers have eccentric cams 26A and 26B, respectively, holding contact with a recording head 100. An end of the recording head 100 can be moved precisely and finely in the direction as shown by arrow B by rotating the eccentric roller 24A through the cam 26A. In the same manner described above, by rotating the eccentric roller 24B through the cam 26B, the end of the recording head 100 can be moved precisely and finely in the direction as shown by arrow A.

In a mechanism for adjusting the position of a recording head formed as described above, a heat pipe 200 and 201A being mounted in a housing 101, each recording head 100 is put onto its corresponding heat pipe 200 and the heat pipe 200 is gripped between the pressing member 80, which is a flat spring securing each recording head 100, and the recording head 100. At the same time, a head positioning pin 25 placed on one positioning face 101B is inserted into a hole 100B bored in the recording head 100. By contacting the face of the discharging portion of the recording head 100 onto positioning faces 101A and 101B at opposite ends of the recording head 100, the position of the recording head 100 is fixed in the direction as shown by arrow C.

One end of the recording head 100 in the longitudinal direction contacts the pressing spring 23 and the other end of the recording head 100 is constrained by the pressing spring 22 and the eccentric rollers 24A and 24B. By rotating the eccentric roller 24B, it is possible to adjust finely each position of the recording head 100 in the direction as shown by arrow A as well as by rotating the eccentric roller 24A, it is possible to adjust finely the position of the end part of the recording head 100 contacting the eccentric cam 26B in the direction as shown by arrow B around the head positioning pin 25. By means of adjusting operations described above for adjusting finely relative positions of a plurality of recording heads, it is appreciated to establish an exact matching of landing positions of ink droplets with different colors ejected from individual recording heads 100 and to provide a higher quality of recorded images on a recording sheet.

Next, referring again to FIGS. 10 and 11, described is a means for adjusting the amount of warp in an individual recording head 100.

Figure 12:
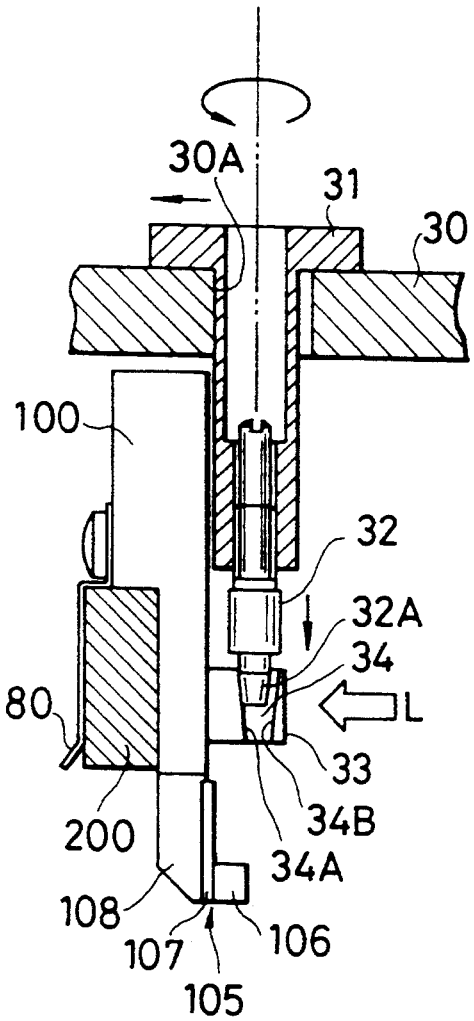
FIGS. 12 and 13 show sectional views of main portions of the embodiment shown in FIGS. 10 and 11.
Figure 13:
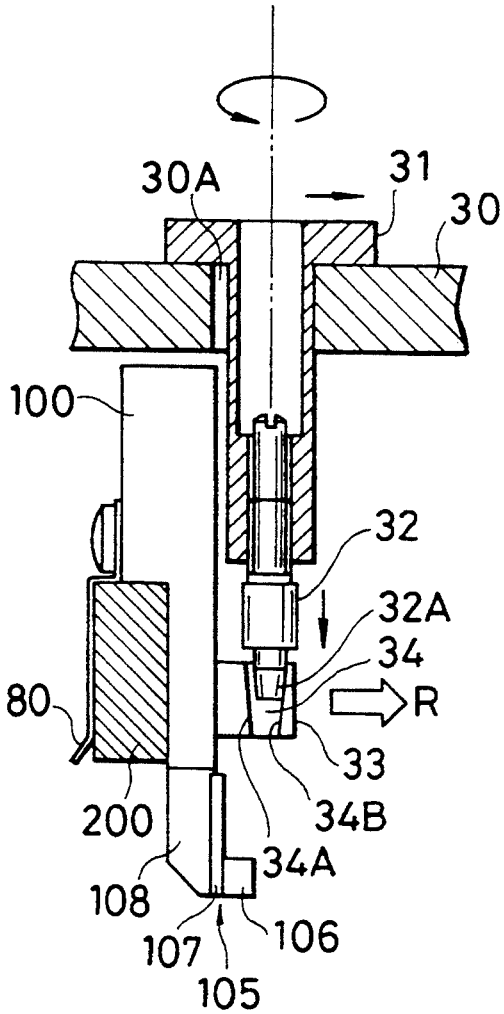

In FIGS. 10 and 11, a component 30 is a mount block laid above a substantially central portion of a housing side wall 101C, a component 31 is a slide block held in the mount block 30. The slide block 31 is placed above the vertical face of each recording head 100. As shown in FIGS. 12 and 13, the slide block 31 is movable in the direction perpendicular to the longitudinal direction of the recording head 100 as shown by an arrow through a slide block support hole 30A in the mount block 30. A component 32 is an adjusting screw threaded into the slide block 31 for adjusting the amount of warp of a recording head and a component 32A is a tapered portion formed at the head of the adjusting screw 32. In the central portion of each recording head 100, there is an adjusting member 33 for adjusting the amount of warp of the recording head, which location corresponds to the slide block 31 and the adjusting screw 32, and a hole 34 is formed in the adjusting member 33 so that the tapered portion 32A can be inserted into the hole. Components 34A and 34B are tapered faces formed in the hole 34.

Owing to the means for adjusting the amount of warp of a recording head as used in the embodiment of the present invention, it is appreciated that, as previously mentioned, the warped shape of a recording head is easily corrected and exact recording images are obtained as shown by broken lines in FIG. 2. In the case of adjusting the amount of warp in the direction as shown by arrow L in a recording head 100 in FIG. 12, by making the relative position of the slide block 31 to the mount block 30 fixed as shown in FIG. 12 and screwing the adjusting screw 32 into the hole 34 as making the tapered portion 32A of the adjusting screw 32 pressing the tapered face 34A in the adjusting member 33, the central portion of the recording head 100 can be moved forward to the intended adjusting direction which is shown by arrow L, accompanied with its corresponding heat pipe 200. In the case of adjusting the amount of warp in the opposite direction as shown by arrow R in FIG. 13, the relative position of the slide block 31 to the mount block 30 is fixed as shown in FIG. 13 and the adjusting screw 32 is screwed into the hole 34 as making the tapered portion 32B of the adjusting screw 32 pressing the tapered face 34B in the adjusting member 33. The means for adjusting the amount of warp of a recording head as described above is not only used in order to correct the amount of warp of a recording head but also can be used in adjusting a plurality of recording heads in order to equalize the amount of warp of all the recording heads mounted.

Figure 15:
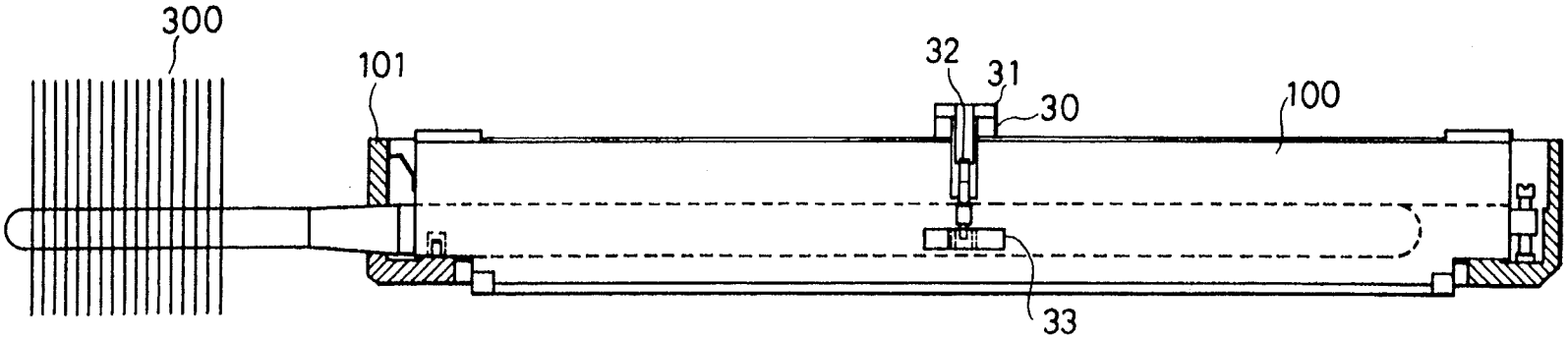
FIG. 15 shows a side sectional view of the recording head unit shown in FIG. 14.

In the embodiment of the present invention described above, disclosed are an adjustment mechanism for recording head position and an adjustment mechanism for adjusting the amount of warp of recording heads where a plurality of heat pipes 200 are connected to one another at the end of the heat pipes and a reservoir of working fluid is formed at the connected portion of heat pipes. The present invention, however, is directed not only to this kind of configuration of recording heads and heat pipes but also to another kind of configuration of recording heads and heat pipes, for example as shown in FIG. 14 and FIG. 15 where individual heat pipes 200 are separately supported by a housing 101, respectively as well as the case where each heat pipe is attached to its corresponding recording head. And further, the present invention can be applied not only to a recording apparatus containing a plurality of recording heads but also to a recording apparatus containing a single or full-line type recording head connected with a heat pipe.

By using the means for adjusting the amount of warp of a recording head described above together with the mechanism of adjusting the position of a recording head, it is possible to provide an ink jet recording apparatus which makes it possible to reduce a distortion of printed out images and especially to reduce color deviations in color printing.

And furthermore, not shown in the drawings, eccentric rollers 24A and 24B can be formed in a double screwed structure. With this structure it is also possible to adjust an interval between the recording head 100 and a recording sheet by moving finely one end of the recording head 100 in the direction perpendicular to the recording sheet. In view of rigidity of a recording head assembly, it is preferable to place the above mentioned head positioning pin 25 on the side of the heat pipe 201A and it is advantageous from the view point of operational easiness.

In using a plurality of recording heads paralleled to one another, as there is a case in which the sum of the amount of warp of two adjacent recording heads with their warp directions opposite to each other is at most twice as large as the sum of the amount of warp of two adjacent recording heads with their warp directions being identical to each other, it is preferable not only to place a correcting mechanism at one side face of a recording head but also to place a correcting mechanism at both side faces of a recording head.

With respect to an external force applied for adjusting the amount of warp of a recording head, it is preferable to apply the external force directly onto the substrate 107 which mainly determines the amount of warp of the recording head. From a point of practical view, however, it is acceptable to apply the external force onto a metal plate, in the embodiment of the present invent ion, an aluminum base plate 108.

As for the position of the adjustment point for applying the external force, it is allowable to place the adjustment point in the center of a recording head in the longitudinal direction and either in the center of the recording head or a region between the center and the discharging portion of the recording head in the latitudinal direction. In addition, in the above embodiment of the present invention, though the longitudes of the recording heads are positioned perpendicular to the direction in which a recording sheet is fed, it is acceptable to arrange the recording heads so that the longitudes of the recording heads may be slanted. Even in this case, the plurality of recording heads should be parallel to one another.

As a means for adjusting the amount of warp of recording heads as described above enables to adjust the amount of warp of recording heads without increasing an interval between adjacent recording heads, it is possible to form a small-sized assembly of a single recording head unit or a multiple recording head unit. In addition to the above advantage, by means of reduction of memory size, it is possible to provide an ink jet recording apparatus at lower cost. As for a desirable value of the correctable amount of warp of recording heads, it is desirable to form an adjusting means so as to establish the correctable amount of warp to be about from 0.02 mm to 0.025 mm when the length of the recording head is about 300 mm.

In summing up, the embodiments of the present invention described above are as follows. The embodiment of the present invent ion provides two structures; (1) a structure in which a first heat exchange portion, which is involved in a means for exchanging heat having a first and a second heat exchange part, is placed along and contacted to the longer side of each recording head, which structure is not necessarily required, and (2) a structure which, by supporting opposite ends of each of a plurality of recording heads onto predetermined positions respectively, and by operating a means for adjusting the amount of warp of recording heads used for altering a direction in which an external force is applied to each of a plurality of recording heads being maintained to be supported, applies an external force onto an almost central portion of recording heads being adjusted and adjusts the amount of the external force applied. Owing to the structures described above, it is possible to correct a warped shape of each recording head easily in a great amount and even to remove warp of each recording head. As a result, it is possible to provide a highly quality recording images without distortion on a recording sheet.

In addition, by adjusting the amount of warp of recording heads which alters a direction in which an external force is applied to individual recording heads, it is possible to form a small-sized assembly of recording heads installed in an ink jet recording apparatus. By applying the present invention, it is possible to stabilize a head cleaning means applied to recording heads and to keep a material contacting recording heads such as an ink absorbing material in a good contacting condition.

VARIOUS ASPECTS OF THE INVENTION

The present invention is particularly suitably useable in an ink jet recording head having heating elements that produce thermal energy as energy used for ink ejection and recording apparatus using the head. This is because, the high density of the picture element, and the high resolution of the recording are possible.

The typical structure and the operational principle are preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electro-thermal transducer disposed on a liquid (ink) retaining sheet or liquid passage, the driving signal being enough to provide such a quick temperature rise beyond a departure from nucleate boiling point, by which the thermal energy is provided by the electro-thermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electro-thermal transducer as disclosed in the above-mentioned patents. In addition, the present invent ion is applicable to the structure disclosed in Japanese Patent Application Laid-Open No. 123670/1984 wherein a common slit is used as the ejection outlet for a plurality of electro-thermal transducers, and to the structure disclosed in Japanese Patent Application Laid-open No. 138461/1984 wherein an opening for absorbing pressure waves of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plurality recording head combined to cover the entire width.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electro-thermal transducer or by a combination of the ejection electro-thermal transducer and additional heating element and means for preliminary ejection not for the recording operation, which can stabilize the recording operation.

As regards the kinds and the number of the recording heads mounted, a single head corresponding to a single color ink may be equipped, or a plurality of heads corresponding respectively to a plurality of ink materials having different recording color or density may be equipped. The present invention is effectively applicable to an apparatus having at least one of a monochromatic mode solely with main color such as black and a multi-color mode with different color ink materials or a full-color mode by color mixture. The multicolor or full-color mode may be realized by a single recording head unit having a plurality of heads formed integrally or by a combination of a plurality of recording heads.

Furthermore, in the foregoing embodiment, the ink has been liquid. It may, however, be an ink material solidified at room temperature or below and liquefied at room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invent ion is applicable to such an ink material as is liquefied by the application of the thermal energy. Such an ink material may be retained as a liquid or solid material through holes or recesses formed in a porous sheet as disclosed in Japanese Patent Application Laying-Open No. 56847/1979 and Japanese Patent Application Laying-Open No. 71260/1985. The sheet is faced to the electro-thermal transducers. The most effective one for the ink materials described above is the film boiling system.

The ink jet recording apparatus may be used as an output means of various types of information processing apparatus such as a work station, personal or host computer, a word processor, a copying apparatus combined with an image reader, a facsimile machine having functions for transmitting and receiving information, or an optical disc apparatus for recording and/or reproducing information into and/or from an optical disc. These apparatus requires means for outputting processed information in the form of hand copy.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. An ink jet recording apparatus having a frame, the apparatus comprising:

means for feeding a recording medium in a predetermined feeding direction;

a full-line type ink jet recording head extending in a direction perpendicular to the predetermined feeding direction so as to have a recording width which is perpendicular to the predetermined feeding direction of the recording medium, said full-line type ink jet recording head being fixedly supported by said frame at opposite ends thereof for recording on the recording medium within the recording width; and displacing means for reducing an amount of warp of said full-line type ink jet recording head parallel to the predetermined feeding direction of the recording medium by applying opposing forces to a central portion of said full-line type ink jet recording head located between the opposite ends thereof, wherein said displacing means displaces said full-line type ink jet recording head in the predetermined feeding direction of the recording medium by adjusting said opposing forces.

2. An ink jet recording apparatus according to claim 1, wherein a thickness of the central portion of said full-line type ink jet recording head is smaller than the opposite ends thereof.

3. An ink Jet recording apparatus according to claim 1, wherein said displacing means comprises a mechanism for manually applying a force in a predetermined direction, altering the direction of the applied force, and for displacing said full-line type ink jet recording head in the predetermined feeding direction of the recording medium.

4. An ink Jet recording apparatus according claim 1, wherein said full-line type ink Jet recording head comprises a base plate formed of metal and wherein said displacing means applies force to the base plate so as to displace the base plate.

5. An ink jet recording apparatus having a frame, the apparatus comprising:

means for feeding a recording medium in a predetermined feeding direction;

a first full-line type ink jet recording head extending in a direction perpendicular to the predetermined feeding direction so as to have a recording width which is perpendicular to the predetermined feeding direction of the recording medium, said first full-line type ink jet recording head being fixedly supported by said frame at opposite ends thereof for recording on the recording medium within the recording width;

a second full-line type ink jet recording head extending in a direction perpendicular to the predetermined feeding direction so as to have a recording width with respect to the predetermined feeding direction of the recording medium, said second full-line type ink jet recording head being located downstream of said first recording head with respect to the predetermined feeding direction of said recording medium and discharging ink different from that of said first recording head, and said second full-line type ink jet recording head being fixedly supported by said frame at opposite ends thereof so as to be parallel to said first recording head for recording on the recording medium within the recording width;

first displacing means for reducing an amount of warp of said first full-line type ink jet recording head by applying opposing forces to a central portion of said first recording head located between the opposite ends thereof; and second displacing means for reducing an amount of warp of said second full-line type ink jet recording head by applying opposing forces to a central portion of said second recording head located between the opposite ends thereof, wherein said first and second displacing means displace said first recording head and said second recoding head, respectively parallel to the predetermined feeding direction of the recording medium by adjusting application of said opposing forces, receptively, whereby it becomes possible to record on the recording medium a different ink discharged from said second recording head at a same position on the recording medium as an ink discharged from said first recording head.

6. An ink jet recording apparatus according to claim 5, wherein a thickness of the central portion of each of said first full-line type ink jet recording head and said second full-line type ink jet recording head is smaller than the opposite ends thereof.

7. An ink jet recording apparatus according to claim 5, wherein each of said first and second displacing means comprises a mechanism for manually applying a force in a predetermined direction, altering the direction of the applied force, and for displacing said first full-line type ink jet recording head and said second full-line type ink jet recording head, respectively, in the predetermined feeding direction of the recording medium.

8. An ink Jet recording apparatus according to claim 5, wherein each of said first full-line type ink jet recording head and second full-line type ink jet recording heads comprise a base plate formed of metal, and said wherein said first and second displacing means apply force to each said metal plate, respectively, so as to displace each said metal plate.

9. An ink jet recording apparatus having a frame, comprising:

means for feeding a recording medium in a predetermined direction;

a full-line type ink jet recording head extending in a direction parallel to the predetermined feeding direction so as to have a recording width which is perpendicular to the predetermined feeding direction of the recording medium, said full-line type ink jet recording head having a plurality of ink jet discharging orifices arranged along the recording width, a common liquid chamber communicating with said plurality of ink jet discharging orifices, a plurality of electro-thermal conversion elements associated with said discharging orifices for generating thermal energy, and a base plate having said liquid chamber and said electro-thermal conversion elements on a first surface side thereof, said full-line type ink jet recording head being fixedly supported by said frame at opposite ends thereof for recording on the recording medium within the recording width;

equalizing means contacting a second surface of said base plate opposite the first surface side thereof, for equalizing thermal distribution along a longitudinal direction of said full-line type ink jet recording head, wherein said equalizing means exchanges heat with the atmosphere at a portion of said apparatus outside of the recording width of said recording head;

displacing means for reducing an amount of warp of said full-line type ink jet recording head by applying force to the first surface side of said base plate at a central portion of said recording head located between the opposite ends thereof and distant from said common liquid chamber, wherein said displacing means displaces said full-line type ink jet recording head in the predetermined feeding direction of the recording medium; and means, disposed at the opposite ends of said full-line type recording head, for adjusting a location of said recording head.

10. An ink jet recording apparatus according to claim 9, wherein said displacing means comprises a mechanism for manually applying a force in a predetermined direction, altering the direction of the applied force, and for displacing said full-line type ink jet recording head in the predetermined feeding direction.

11. An ink jet recording apparatus having a frame, the apparatus comprising:

means for feeding a recording medium in a predetermined feeding direction;

a plurality of full-line type ink jet recording heads extending in a direction perpendicular to the predetermined feeding direction so as to have recording widths which is perpendicular to the predetermined feeding direction of the recording medium, said full-line type ink jet recording heads each having a plurality of ink jet discharging orifices arranged along the recording width, a common liquid chamber communicating with said plurality of ink jet discharging orifices, a plurality of electro-thermal conversion elements associated with said discharging orifices for generating thermal energy, and a base plate having said liquid chamber and said electro-thermal conversion elements on a first surface side thereof, said full-line type ink jet recording heads each being fixedly supported by said frame at opposite ends thereof for recording on the recording medium within the recording width;

equalizing means contacting a second surface side of each said base plate opposite the first surface side thereof, for equalizing a thermal distribution along a longitudinal direction of said full-line type ink jet recording heads, respectively, wherein said equalizing means exchanges heat with the atmosphere at a portion of said apparatus not within the recording width of said recording head;

displacing means for reducing an amount of warp of each of said full-line type ink jet recording heads by applying force to the first surface side of each said base plate at central portions of said recording heads located between the opposite ends thereof and distant from said common liquid chamber, wherein said displacing means displaces each of said full-line type ink jet recording heads in the predetermined feeding direction of the recording medium; and means, disposed at the opposite ends of each of said full-line type recording heads, for adjusting relative positions of adjacent recording heads.

12. An ink jet recording apparatus according to claim 11, wherein said displacing means comprises a mechanism for manually applying a force in a predetermined direction, altering the direction of the applied force, and for displacing said full-line type ink Jet recording heads in the predetermined feeding direction of the recording medium.

13. An ink jet recording apparatus according to claim 1, wherein said full-line ink jet recording head has ink therein and comprises a plurality of electro-thermal conversion elements for imparting thermal energy to said ink to cause film boiling of said ink and discharge thereof from said recording head.

14. An ink jet recording apparatus according to claim 5, wherein each of said full-line ink jet recording heads has ink therein and comprises a plurality of electro-thermal conversion elements for imparting thermal energy to said ink to cause film boiling of said ink and discharge thereof from said recording head.

15. An ink jet recording apparatus according to claim 9, wherein said full-line ink jet recording head has ink therein and said electro-thermal conversion elements are disposed for imparting thermal energy to said ink to cause film boiling of said ink and discharge thereof from said recording head.

16. An ink jet recording apparatus according to claim 11, wherein each of said full-line ink jet recording heads has ink therein and said electro-thermal conversion elements are disposed for imparting thermal energy to said ink to cause film boiling of said ink and discharge thereof from said recording head.

* * * * *

UNITED STATES PATENT AND TRADEMARK OFFICE

CERTIFICATE OF CORRECTION

PATENT NO. : 5,343,227

DATED : August 30, 1994

INVENTOR(S) : TOSHIAKI HIROSAWA ET AL.

It is certified that error appears in the above-identified patent and that said Letters Patent is hereby corrected as shown below:

On the title page,

AT [54] TITLE

"REDUCING" should read --FOR REDUCING--

AT [56] REFERENCES CITED

U.S. Patent Documents,
"3,929,327 12/1975 Olson ..... 271/250
4,496,257 1/1985 Habelt et al. ..... 400/578
4,728,967 3/1988 Tomita et al. ..... 346/136
4,750,422 6/1988 Gysin ..... 101/426
4,938,129 7/1990 Miciukiewicz et al. .. 101/76"
should all be deleted.

AT [57] ABSTRACT

Line 1, "into" should read --in--.

COLUMN 1

Figure 6:
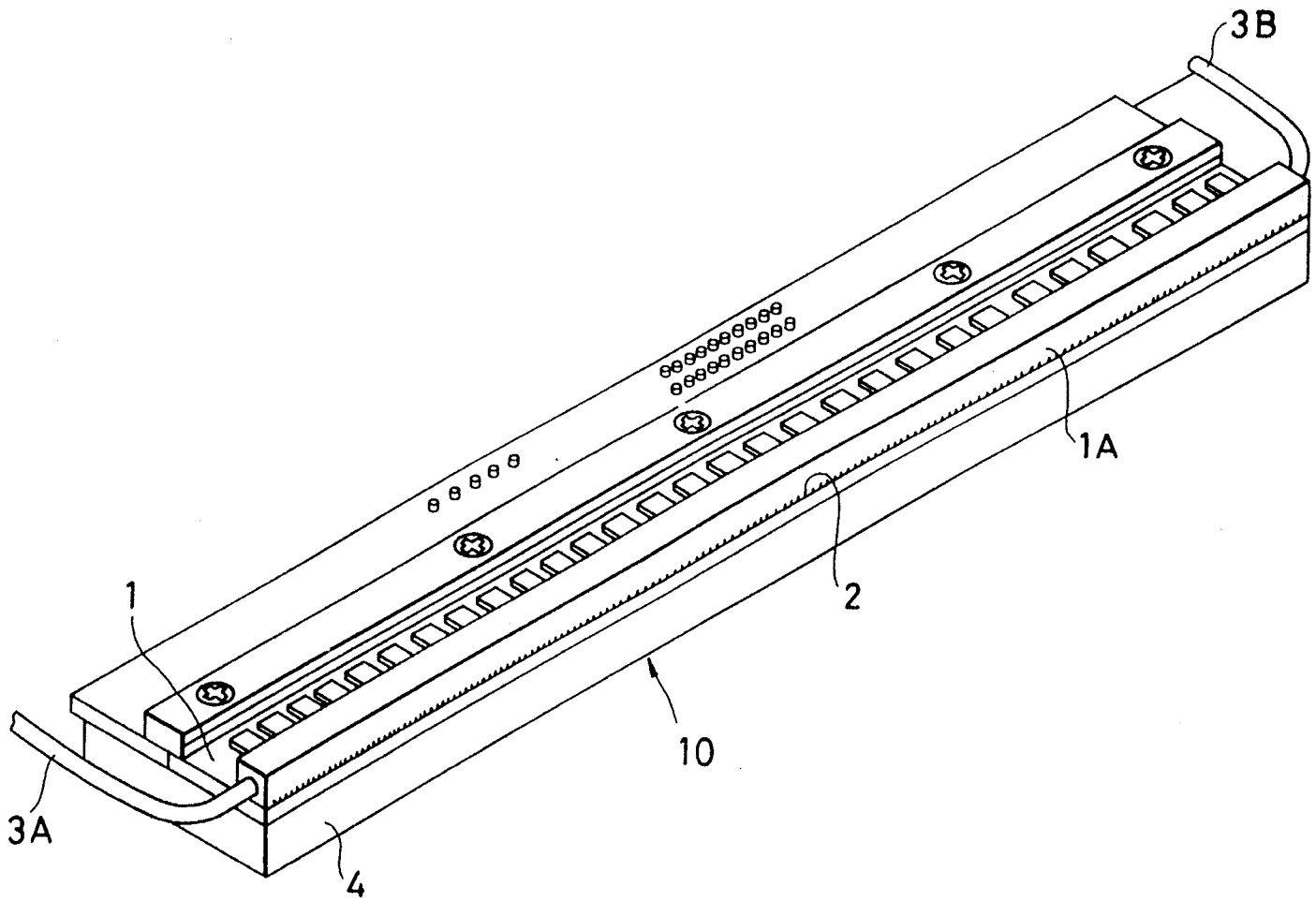
FIG. 6 PRIOR ART
FIG. 6 is a perspective view of a conventional ink jet recording head.
Figures 7A, 7B:
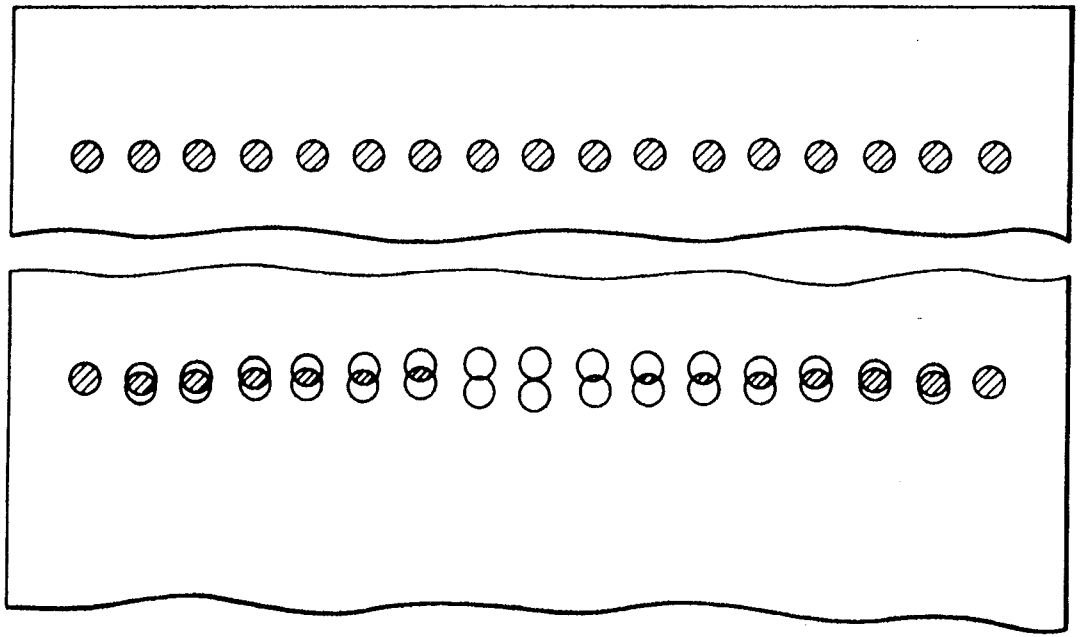
FIGS. 7A and 7B illustrate a mismatch situation of ink droplets due to a warped shape of a recording head.

Line 3, "REDUCING" should read --FOR REDUCING--.
Line 18, "heads;" should read --heads:--.
Line 25, "one dimensional" should read --one-dimensional--.
Line 38, "FIG. 6;" should read --FIG. 6--.

COLUMN 2

Line 6, "direct ion" should read --direction--.

UNITED STATES PATENT AND TRADEMARK OFFICE

CERTIFICATE OF CORRECTION

PATENT NO. : 5,343,227

DATED : August 30, 1994

INVENTOR(S) : TOSHIAKI HIROSAWA ET AL.

It is certified that error appears in the above-identified patent and that said Letters Patent is hereby corrected as shown below:

COLUMN 3

Line 6, "one dimensionally" should read --one-dimensionally--.
Line 22, "direct ion;" should read --direction;--.
Line 25, "direction" should read --direction.--.
Line 33, "comprise;" should read --comprise:--.
Line 46, "comprise;" should read --comprise:--.
Line 67, "secondary" should read --second--.

COLUMN 4

Line 12, "comprises;" should read --comprises:--.
Line 20, "heads" should read --heads,--.
Line 24, "portion,thereby" should read --portion, thereby--.
Line 29, "head;" should read --head; and--.
Line 39, "one dimensionally" should read --one-dimensionally--.
Line 42, "direct ion" should read --direction--.
Line 56, "one dimensionally" should read --one-dimensionally--.

COLUMN 5

Line 20, "cross sec-" should read --cross-sec- --.
Line 21, "lines A-A" should read --lines 1B-1B--.
Line 30, "cross sec-" should read --cross-sec- --.
Line 31, "lines A-A" should read --lines 4B-4B--.

UNITED STATES PATENT AND TRADEMARK OFFICE

CERTIFICATE OF CORRECTION

PATENT NO. : 5,343,227

DATED : August 30, 1994

INVENTOR(S) : TOSHIAKI HIROSAWA ET AL.

It is certified that error appears in the above-identified patent and that said Letters Patent is hereby corrected as shown below:

COLUMN 6

Line 35, "steps;" should read --steps:--.

COLUMN 7

Line 12, "printing;" should read --printing:--.
Line 32, "10M 10Y" should read --10M, 10Y--.
Line 41, "overlap" should read --overlaps--.

COLUMN 8

Line 3, "direction ," should read --direction,--.
Line 15, "one dimensional" should read --one-dimensional--.
Line 45, "inventions;" should read --inventions:--.

COLUMN 9

Line 64, "(R) ," should read --(R),--.

COLUMN 10

Line 24, "dryout" should read --dry-out--.
Line 55, "passing" should read --is passing--.

UNITED STATES PATENT AND TRADEMARK OFFICE

CERTIFICATE OF CORRECTION

PATENT NO. : 5,343,227

DATED : August 30, 1994

INVENTOR(S) : TOSHIAKI HIROSAWA ET AL.

It is certified that error appears in the above-identified patent and that said Letters Patent is hereby corrected as shown below:

COLUMN 11

Line 2, "(bit" should read --(bits--.
Line 40, "cross" should read --cross- --.
Line 42, "head" should read --heat--.
Line 54, "to" should be deleted.

COLUMN 12

Line 15, "invent ion" should read --invention--.
Line 37, "have," should read --has,--.
Line 61, "direct ion" should read --direction--.

COLUMN 14

Line 67, "above mentioned" should read --above-mentioned--.

COLUMN 15

Line 1, "view point" should read --viewpoint--.
Line 20, "invent ion," should read --invention,--.
Line 51, "invent ion" should read --invention-- and "structures;" should read --structures:--.

COLUMN 16

Line 2, "a highly" should read --high--.
Line 25, "particularly" should read --particularly;--.
Line 53, "invent ion" should read --invention--.

UNITED STATES PATENT AND TRADEMARK OFFICE

CERTIFICATE OF CORRECTION

PATENT NO. : 5,343,227

DATED : August 30, 1994

INVENTOR(S) : TOSHIAKI HIROSAWA ET AL.

It is certified that error appears in the above-identified patent and that said Letters Patent is hereby corrected as shown below:

COLUMN 17

Line 1, "recording head" should read --recording heads--.
Line 23, "multicolor" should read --multi-color--.
Line 45, "invent ion" should read --invention--.
Line 50, "Laying-Open" should read --Laid-Open--.
Line 51, "Laying-Open" should read --Laid-Open--.
Line 63, "apparatus requires" should read --apparatuses require--.

COLUMN 18

Line 2, "invention," should read --intention,--.
Line 33, "Jet" should read --jet--.
Line 40, "Jet" should read --jet--.
Line 41, "Jet" should read --jet--.

COLUMN 19

Line 17, "recoding" should read --recording-- and "respectively" should read --respectively,--.
Line 39, "Jet" should read --jet--.
Line 41, "second" should read --said second--.
Line 42, "heads" should read --head--.

COLUMN 20

Line 35, "is" should read --are--.

UNITED STATES PATENT AND TRADEMARK OFFICE

CERTIFICATE OF CORRECTION

PATENT NO. : 5,343,227

DATED : August 30, 1994

INVENTOR(S) : TOSHIAKI HIROSAWA ET AL.

It is certified that error appears in the above-identified patent and that said Letters Patent is hereby corrected as shown below:

COLUMN 21

Line 8, "Jet" should read --jet--.

Signed and Sealed this

Fourteenth Day of March, 1995

Bruce Lehman

*Attest:*

BRUCE LEHMAN

*Attesting Officer*

*Commissioner of Patents and Trademarks*